US005716204A

United States Patent [19]

Mifune et al.

[11] Patent Number: 5,716,204

[45] Date of Patent: Feb. 10, 1998

[54] COMBUSTION DEVICE IN LIGHTERS

[75] Inventors: Hideo Mifune; Noriyuki Serizawa; Masato Seki; Shinichi Okawa, all of Shizuoka-ken, Japan

[73] Assignee: Tokai Corporation, Kanagawa-ken, Japan

[21] Appl. No.: 741,293

[22] Filed: Oct. 30, 1996

Related U.S. Application Data

[63] Continuation of Ser. No. 503,386, Jul. 17, 1995, abandoned.

[51] Int. Cl.[6] ..... F23Q 3/01

[52] U.S. Cl. ..... 431/344; 431/355; 431/353; 431/264

[58] Field of Search ..... 431/344, 353, 431/350, 355, 354, 351, 8, 10, 187, 268

[56] References Cited

U.S. PATENT DOCUMENTS

| | | | |
|---|---|---|---|
| 316,059 | 4/1885 | Randol . | |
| 992,351 | 5/1911 | Foss | 431/351 |
| 1,311,235 | 7/1919 | Kemp et al. | 431/351 |
| 1,862,673 | 6/1932 | Foster . | |
| 2,720,257 | 10/1955 | Lynes . | |
| 3,125,153 | 3/1964 | Lindgren | 431/353 X |
| 3,779,694 | 12/1973 | Zagoroff . | |
| 3,849,058 | 11/1974 | Pankow . | |
| 3,986,817 | 10/1976 | Lambiris | 431/353 X |
| 4,097,224 | 6/1978 | Cooksley | 431/355 X |
| 4,416,613 | 11/1983 | Barisoff | 431/353 X |
| 5,055,033 | 10/1991 | Lee . | |
| 5,131,840 | 7/1992 | Zettner | 431/355 X |

*Primary Examiner*—Carl D. Price

*Attorney, Agent, or Firm*—Brumbaugh, Graves, Donohue & Raymond

[57] ABSTRACT

A combustion device in a lighter, such as a gas lighter, comprises a base portion, which is associated with a nozzle for jetting a fuel gas and is provided with a primary air hole for introducing primary air into the fuel gas having been jetted from the nozzle, and a combustion cylinder, in which the fuel gas containing the primary air mixed in is burned. The combustion cylinder has a multiple pipe structure comprising a combustion inner pipe, in which the fuel gas containing the primary air mixed in flows, and a combustion outer pipe, which is located around the outer periphery of the combustion inner pipe and at a predetermined spacing from the combustion inner pipe. The space, which is defined between the combustion inner pipe and the combustion outer pipe, is formed as a secondary air flow path, through which secondary air is supplied to a combustion flame.

12 Claims, 15 Drawing Sheets

FIG. 4
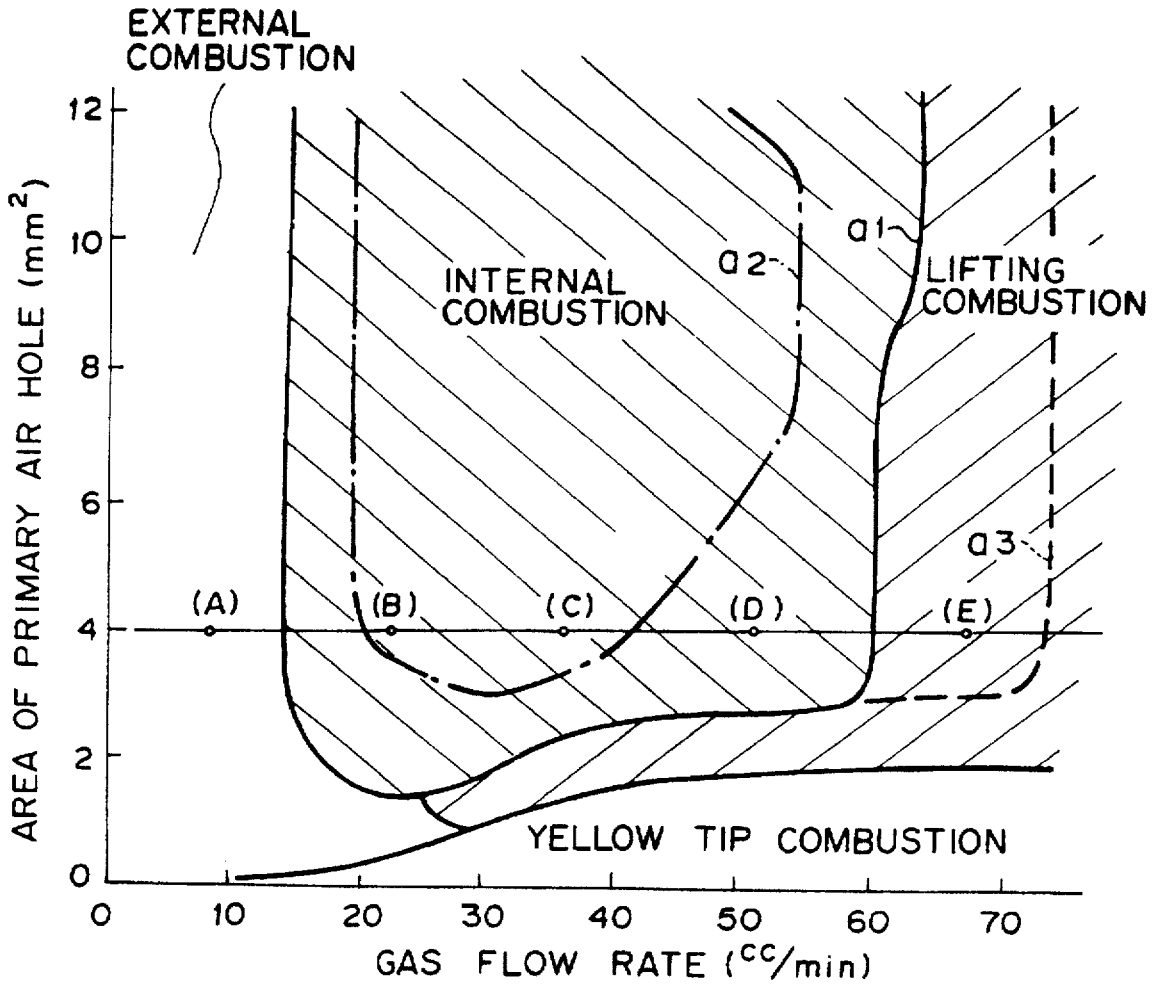
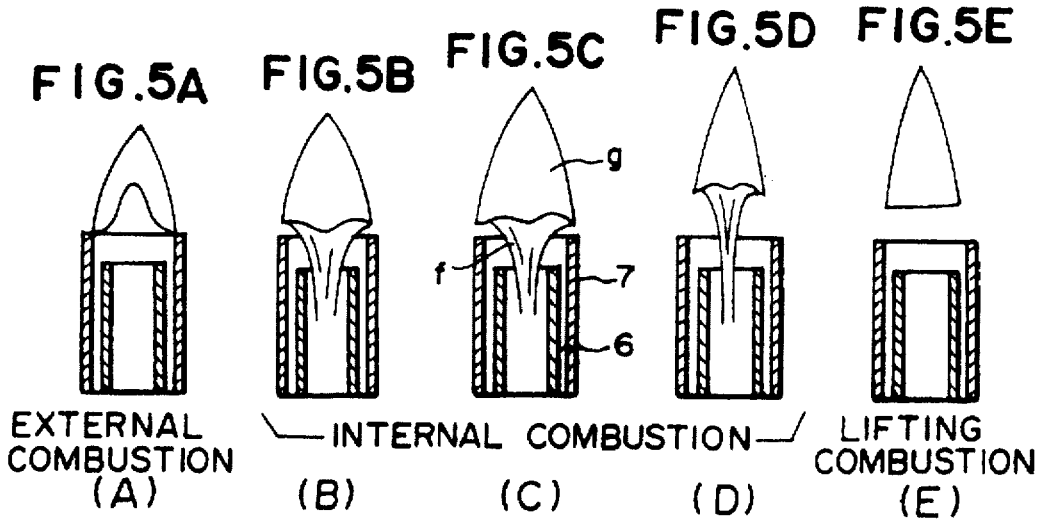

COMBUSTION DEVICE IN LIGHTERS

This application is continuation of application Ser. No. 08/503,386, filed on Jul. 17, 1995, now abandoned.

BACKGROUND OF THE INVENTION

1. Field of the Invention

This invention relates to a combustion device, which is provided with a combustion cylinder, in a lighter, such as a gas lighter for smoker's requisites or a pilot burner.

2. Description of the Prior Art

In conventional lighters, such as gas lighters, in general, a nozzle for jetting a fuel gas is located in a wind-proof cap, secondary air is introduced through an air intake aperture of the wind-proof cap, and the gas jetted from the nozzle is thereby burned. The gas jetted from the nozzle burns such that a flame may be produced which has the same shape as the shape of a flame of a candle and which has a length proportional to the amount of the gas jetted from the opening of the nozzle. The upper half of the flame is red-yellow.

Lighters, such as gas lighters, have also been proposed wherein primary air is mixed into a gas having been jetted from a nozzle such that a portion of a flame may be produced on the side inward from a combustion cylinder. With the technique for burning by mixing primary air into a gas, the nozzle is located at a lower end of the combustion cylinder, and a primary air hole is formed through a side surface of the lower end of the combustion cylinder. In this manner, primary air is introduced through the primary air hole by the effects of the gas flow jetted from the nozzle, and the introduced primary air is mixed with the gas. In such cases, internal combustion can be achieved wherein a portion of a flame is produced on the side inward from a top end of the combustion cylinder. Also, ambient air (secondary air) is introduced from the open top end of the combustion cylinder, and therefore the combustion efficiency can be kept high.

With the aforesaid technique for burning by mixing primary air into a gas, the gas burns with a blue flame at a position spaced away from the opening of the nozzle. The flame produced by introducing the secondary air has a high temperature and a strong fire power and does not go out easily even when it is exposed to wind. The blue flame is effective in cases where a flame reaction agent is brought into contact with a flame in order to color the flame, or in cases where a catalyst is utilized in order to again light a fuel gas by heat of the catalyst when the flame has gone out.

However, in cases where a gas having been mixed with the primary air is burned with a combustion cylinder in the manner described above, the state of combustion varies in accordance with ambient conditions. Therefore, it is not always possible to obtain stable internal combustion.

Specifically, in cases where the internal combustion is to be obtained, a fuel gas having been jetted from a nozzle is introduced into a combustion cylinder. A primary air hole is located in the vicinity of a fuel gas introducing section of the combustion cylinder, and the primary air is introduced through the primary air hole into the combustion cylinder by utilizing a negative pressure, which is caused to occur in the combustion cylinder by the jet flow of the fuel gas. The primary air and the fuel gas are mixed with each other in the combustion cylinder. The resulting mixed gas is lighted, and a flame is thereby produced such that at least a portion of the flame may be located in the combustion cylinder. The gas further burns with the ambient secondary air being taken up at the top end opening of the combustion cylinder. In such cases, the gas combustion conditions at the top end of the combustion cylinder are delicate. Such that desired internal combustion can always be carried out, it is necessary for the gas flow velocity, the gas flow rate, the amount of the primary air mixed in, and the amount of the secondary air mixed in to satisfy sufficient conditions. Therefore, in general, lighters for carrying out the internal combustion are provided with an adjustment mechanism, which enables it to adjust both or either one of the gas flow rate and the amount of the primary air. However, the adjustment of both or either one of the gas flow rate and the amount of the primary air in accordance with the ambient conditions is delicate and not easy to carry out. Further, it cannot be expected that the adjustment can be carried out accurately by users who are not familiar with adjustment characteristics.

For example, in cases where the state of combustion is investigated by forming a primary air hole at a bottom portion of a single pipe-like combustion cylinder, locating a nozzle, changing the amount of the primary air with alteration of the area of the opening of the primary air hole, and altering the gas flow rate, it is found that the desired internal combustion can be obtained when the gas flow rate and the amount of the primary air fall within an appropriate range. However, in the region in which the gas flow rate is lower than the internal combustion region, and in the region in which the amount of the primary air is smaller than the internal combustion region, external combustion occurs wherein a flame is produced only on the side outward from the opening of the combustion cylinder and extends from the opening of the combustion cylinder. In the region in which the gas flow rate is higher than the internal combustion region, the gas flow velocity becomes higher than the rate of combustion of the gas, and therefore a lifting combustion phenomenon occurs wherein a flame is blown off and is produced at a position outward and spaced away from the opening of the combustion cylinder. In the region in which the gas flow rate is increased even further or in which the amount of the primary air is decreased even further, a yellow tip combustion phenomenon occurs wherein a red-yellow portion occurs from imperfect combustion at the tip of the flame. The abnormal combustion described above occurs in a state in which perfect combustion of the gas is not carried out. In such cases, there is the tendency for the combustion temperature to become low. In particular, in the region in which the amount of the primary air becomes insufficient due to a small primary air hole or an increased amount of the gas jetted, the internal combustion cannot be obtained. Thus the internal combustion region becomes narrow.

As described above, the desired internal combustion can be obtained by setting and adjusting the relationship among the primary air, the secondary air, and the fuel gas. However, the internal combustion region is comparatively narrow. For example, if the ambient temperature changes, the internal pressure of the stored fuel gas will fluctuate, and therefore the gas jetting pressure, i.e. the gas flow rate, will change. If the temperature becomes high, the gas flow rate will increase, the proportion of the primary air mixed in will decrease, and therefore the primary air will become insufficient. As a result, the combustion conditions will change, and the internal combustion cannot be obtained.

Also, when the internal combustion is carried out, the surface temperature of the side wall of the combustion cylinder becomes high due to the combustion in the combustion cylinder. Therefore, it is necessary to employ a support structure, or the like, for coping with the rise in the surface temperature of the side wall of the combustion cylinder, and the structure of the lighter cannot be kept simple.

SUMMARY OF THE INVENTION

The primary object of the present invention is to provide a combustion device in a lighter, wherein an internal combustion region, in which internal combustion in a combustion cylinder is capable of occurring, is kept broad, and adjustment with respect to a fluctuation of combustion conditions is thereby kept simple or made unnecessary.

Another object of the present invention is to provide a combustion device in a lighter, wherein the surface temperature of a combustion cylinder with respect to the exterior is kept low, and a support structure for the combustion cylinder is thereby kept simple.

The present invention provides a combustion device in a lighter, such as a gas lighter, comprising:

i) a base portion, which is associated with a nozzle for jetting a fuel gas and is provided with a primary air hole for introducing primary air into the fuelgas having been jetted from the nozzle, and ii) a combustion cylinder, in which the fuel gas containing the primary air mixed in is burned, wherein the combustion cylinder has a multiple pipe structure comprising a combustion inner pipe, in which the fuel gas containing the primary air mixed in flows, and a combustion outer pipe, which is located around the outer periphery of the combustion inner pipe and at a predetermined spacing from the combustion inner pipe, and the space, which is defined between the combustion inner pipe and the combustion outer pipe, is formed as a secondary air flow path, through which secondary air is supplied to a combustion flame.

In the combustion device in a lighter in accordance with the present invention, the combustion cylinder may have a multiple pipe structure comprising a combustion intermediate pipe, which is located between the combustion inner pipe and the combustion outer pipe, each of the space, which is defined between the combustion inner pipe and the combustion intermediate pipe, and the space, which is defined between the combustion intermediate pipe and the combustion outer pipe, may be formed as the secondary air flow path, through which the secondary air is supplied to the combustion flame.

Alternatively, the combustion cylinder may have a multiple pipe structure comprising an auxiliary pipe, which is located around the outer periphery of the combustion outer pipe and at a predetermined spacing from the combustion outer pipe, and a top end of the auxiliary pipe may be located on the side closer to the base portion of the combustion device than a top end of the combustion outer pipe is. In such cases, a path, which is defined between the combustion outer pipe and the auxiliary pipe, and the secondary air flow path, which is defined between the combustion inner pipe and the combustion outer pipe, may communicate with each other, and the secondary air may be introduced from an open end of the path, which is defined between the combustion outer pipe and the auxiliary pipe. Alternatively, a path, which is defined between the combustion outer pipe and the auxiliary pipe, the primary air hole, and the secondary air flow path, which is defined between the combustion inner pipe and the combustion outer pipe, may communicate with one another, and the primary air and the secondary air may be introduced from an open end of the path, which is defined between the combustion outer pipe and the auxiliary pipe.

The present invention also provides a combustion device in a lighter, such as a gas lighter, comprising:

i) a base portion, which is associated with a nozzle for jetting a fuel gas and is provided with a primary air hole for introducing primary air into the fuel gas having been jetted from the nozzle, and ii) a combustion cylinder, in which the fuel gas containing the primary air mixed in is burned, wherein the combustion cylinder has a multiple pipe structure comprising a combustion inner pipe, in which the fuel gas containing the primary air mixed in flows, and a combustion outer pipe, which is located around the outer periphery of the combustion inner pipe and at a predetermined spacing from the combustion inner pipe, a top end of the combustion outer pipe being formed at a position, which falls within the range of from the same position as the position of a top end of the combustion inner pipe to a position protruding beyond the top end of the combustion inner pipe, the combustion outer pipe is provided with an air introducing section, which is located on the side closer to the base portion of the combustion device than the top end of the combustion inner pipe is, the combustion outer pipe being divided by the air introducing section into a top-portion combustion outer pipe and a base-portion combustion outer pipe, the space, which is defined between the combustion inner pipe and the top-portion combustion outer pipe, is formed as a secondary air flow path, through which secondary air is supplied to a combustion flame, the space, which is defined between the combustion inner pipe and the base-portion combustion outer pipe, communicates with the primary air hole, and the primary air and the secondary air are introduced from the air introducing section.

In the second-described combustion device in a lighter in accordance with the present invention, the combustion cylinder may have a multiple pipe structure comprising a combustion intermediate pipe, which is located between the combustion inner pipe and the combustion outer pipe, a top end of the combustion intermediate pipe may be located on the side closer to the top end of the combustion outer pipe than the air introducing section is, and the space, which is defined between the combustion intermediate pipe and the base-portion combustion outer pipe, may communicate with the primary air hole and with the secondary air flow path, which is defined between the combustion inner pipe and the combustion intermediate pipe.

In the aforesaid combustion devices in a lighter in accordance with the present invention, the combustion inner pipe, the combustion intermediate pipe, or the combustion outer pipe may be constituted of a corrugated-sheet pipe body.

With the combustion device in a lighter in accordance with the present invention, the primary air is introduced and mixed into the fuel gas by the effects of the flow of the fuel gas jetted from the nozzle. The combustion cylinder is constituted as the multiple pipe structure, and the perfect and stable combustion of the fuel gas is carried out by supplying the secondary air from the secondary air flow path at the top end of the combustion inner pipe to the combustion flame. Also, even in the region in which the primary air becomes insufficient due to, for example, an increase in the amount of the gas jetted, the internal combustion can be carried out wherein a portion of the flame is produced on the side inward from the top end of the combustion cylinder. The region, in which the internal combustion can occur, is thus kept broad, and therefore the internal combustion can be kept even if the gas flow rate fluctuates due to a change in the ambient temperature. Accordingly, the adjustment with respect to a fluctuation of combustion conditions can be kept simple or can be made unnecessary. In particular, in cases where the combustion device in a lighter in accordance with the present invention is combined with an automatic gas flow rate adjusting system, the combustion device in a lighter in accordance with the present invention can be rendered completely free of adjustment.

Further, by the internal combustion, the combustion can be carried out such that an appropriate portion of the combustion cylinder may become hot. Therefore, in cases where a flame reaction agent is located in the combustion cylinder in order to carry out colored flame combustion, or in cases where a catalyst is located in the combustion cylinder in order to carry out re-lighting combustion, the degree of freedom of the location of the flame reaction agent or the catalyst can be kept high. Furthermore, a colored flame can be obtained quickly, or the temperature of the catalyst can be raised quickly. Thus the desired function of the flame reaction agent or the catalyst can be obtained quickly.

Moreover, the auxiliary pipe or the base-portion combustion outer pipe may be located such that the top end of the auxiliary pipe or the base-portion combustion outer pipe may be lower than the top end of the combustion inner pipe or the combustion outer pipe and such that the auxiliary pipe or the base-portion combustion outer pipe may cover the outside of the portion of the combustion cylinder, at which the temperature rises due to the combustion. In such cases, heat of the combustion can be shielded, and the surface temperature of the combustion cylinder with respect to the exterior can be kept low. Therefore, a support structure for the combustion cylinder can be kept simple. Also, the selection and the constitution of a member, which is to be located around the combustion cylinder, and a support member becomes easy, and the cost of the combustion device can be kept low. Further, in cases where the auxiliary pipe is constituted such that the primary air or the secondary air can flow on the side inward from the auxiliary pipe, the temperature of the outer side surface can be decreased even further.

In cases where the combustion outer pipe is divided by the air introducing section into the top-portion combustion outer pipe and the base-portion combustion outer pipe, the outer pipe portion for the supply of the secondary air and the outer pipe portion or the auxiliary pipe for the restriction of the rise in the temperature of the outer side surface can be kept small.

BRIEF DESCRIPTION OF THE DRAWINGS

FIG. 4 is a graph showing a state of combustion with the combustion cylinder shown in FIG. 2, FIGS. 5A through 5E are explanatory views showing various states of combustion.

DESCRIPTION OF THE PREFERRED EMBODIMENTS

The present invention will hereinbelow be described in further detail with reference to the accompanying drawings.

<First embodiment>

Figure 1:
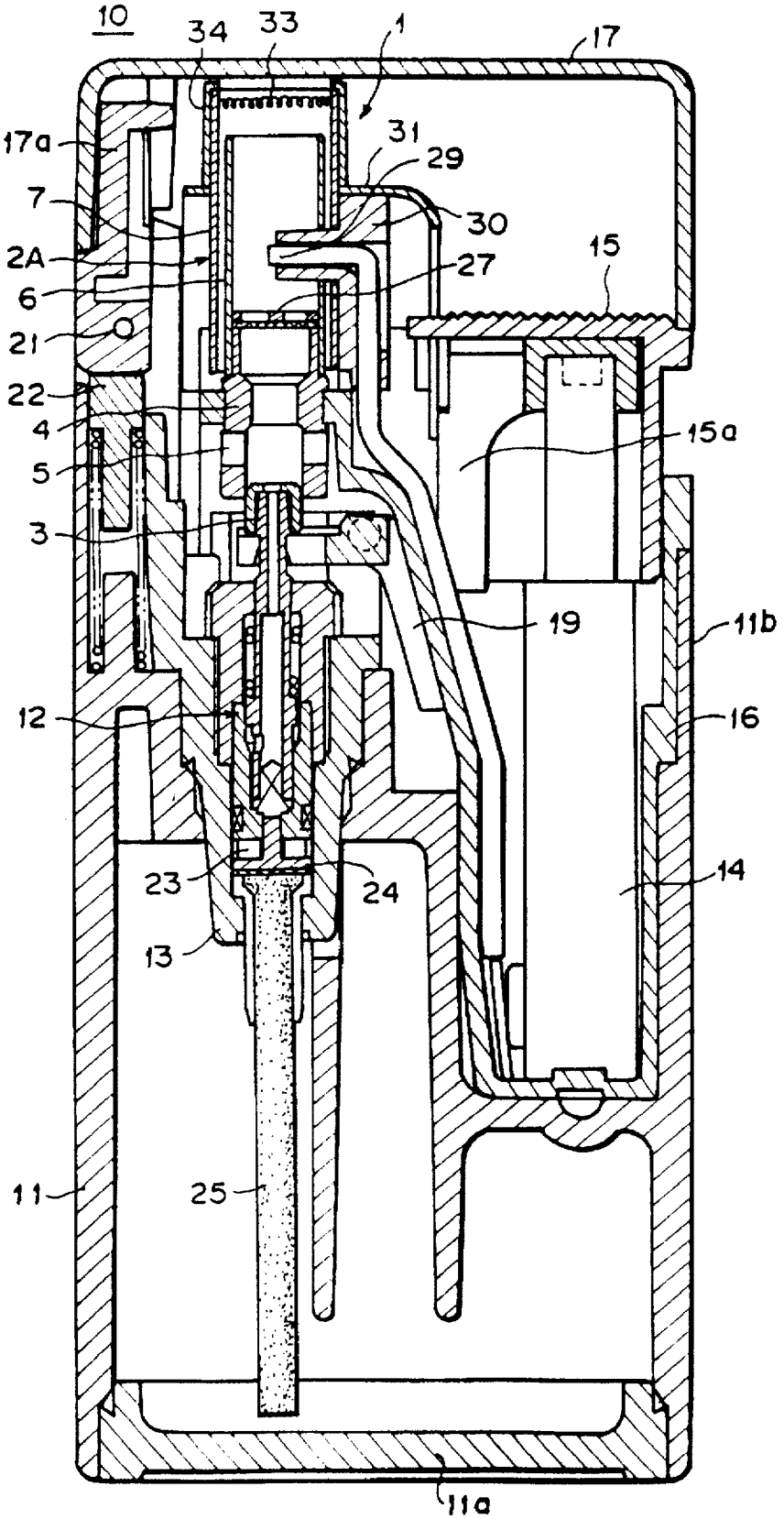
FIG. 1 is a vertical sectional view showing a gas lighter serving as a lighter, which is provided with a first embodiment of the combustion device in accordance with the present invention.
Figure 2:
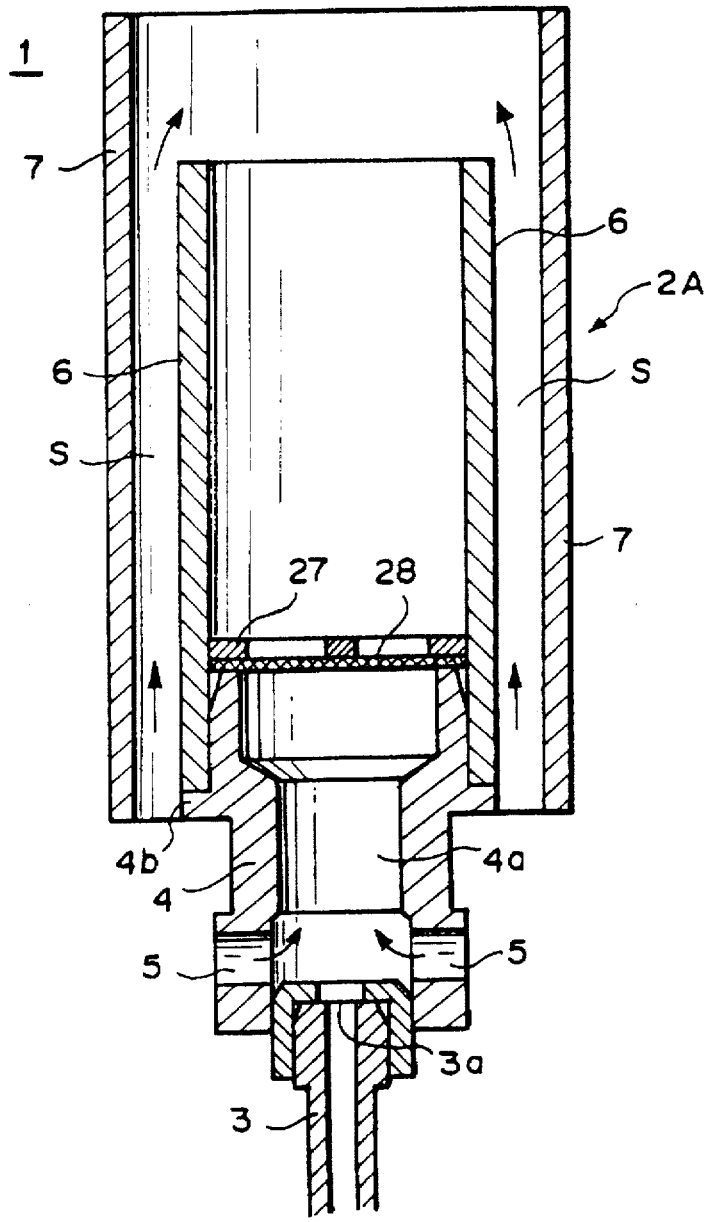
FIG. 2 is an enlarged view showing a combustion cylinder in the first embodiment shown in FIG. 1, in which an electrode part is not shown.

FIG. 1 is a vertical sectional view showing a gas lighter serving as a lighter, which is provided with a first embodiment of the combustion device in accordance with the present invention. FIG. 2 is an enlarged view showing a combustion cylinder in the first embodiment shown in FIG. 1, in which an electrode part is not shown.

A gas lighter 10 (serving as a lighter) is provided with a tank body 11, which stores a fuel gas and is located at the lower part of the gas lighter 10. The tank body 11 is made by molding a synthetic resin. A bottom cover 11*a* is fitted to the bottom portion of the tank body 11, and a high-pressure fuel gas, such as isobutane gas, is stored in the tank body 11. A side wall 11*b* is integrally molded at the upper peripheral surface of the tank body 11. A valve mechanism 12, which is provided with a nozzle 3 for jetting the fuel gas, is accommodated in a valve housing 13. The valve housing 13, in which the valve mechanism 12 is accommodated, is fitted into an upper end of the tank body 11. A combustion device 1 provided with a combustion cylinder 2A, in which the fuel gas having been jetted from the nozzle 3 is burned, is located above the nozzle 3.

A piezo-electric unit 14 is located along a side of the valve mechanism 12. An operation member 15 is located at an upper end of the piezo-electric unit 14. The operation member 15 operates the valve mechanism 12 in order to jet the fuel gas from the nozzle 3 and operates the piezo-electric unit 14 in order to light the fuel gas having been jetted from the nozzle 3. The piezo-electric unit 14, the operation member 15, and the combustion cylinder 2A are supported by an inner housing 16 and coupled with the upper part of the tank body 11.

A rising-falling type of cover 17 opens and closes the upper part of the combustion device 1 and the area above the operation member 15. A fulcrum member **17*a* is secured to the cover 17 and pivotably supported on the tank body 11 by a pin 21. A push-up member 22 is urged upwardly such that it may come into contact with either one of two surfaces of the fulcrum member 17*a* in order to hold the cover 17** at the open position or the closed position.

In the valve mechanism 12, a fuel gas flow path is opened by an upward movement of the nozzle 3, and the fuel gas is jetted from a jet opening **3*a*, which is open at an upper end of the nozzle 3. An L-shaped actuating lever 19 is located such that its one end may be engaged with the nozzle 3. The actuating lever 19 is pivotably supported by a fulcrum located at an intermediate portion of the actuating lever 19. An operating portion at the other end of the actuating lever 19 comes into contact with a lever push piece 15*a* of the operation member 15 and is thereby rotated. In this manner, the actuating lever 19 actuates and ceases the jetting of the fuel gas from the nozzle 3. The upper end of the nozzle 3 is fitted into the bottom of the combustion cylinder 2A of the combustion device 1**.

Also, the valve mechanism 12 is provided with a gas flow rate adjusting filter 23, which adjusts such that the amount of the fuel gas jetted may be kept approximately at a predetermined value even if the temperature changes. The gas flow rate adjusting filter 23 has a disk-like shape and is provided with a circular middle hole. The gas flow rate adjusting filter 23 is located in a compressed state at the bottom of the valve mechanism 12 by a nail-like stator 24. The liquefied fuel gas moves through a porous core 25 from the tank. The liquefied fuel gas, which has moved through the porous core 25, flows radially from the outer periphery of the gas flow rate adjusting filter 23 towards the center of the gas flow rate adjusting filter 23 and is thus vaporized. The gas flow rate adjusting filter 23 is constituted of a micro-cell polymer foam comprising open cells, which communicate with one another through micro-pores at points of contact and thus constitute a gas flow path, and closed cells, which expand or contract with a change in temperature and thereby compress or enlarge the gas flow path. The gas flow rate adjusting filter 23 has the effects of automatically adjusting the gas flow rate with respect to a change in temperature.

The combustion cylinder 2A of the combustion device 1 comprises a base member 4, which is located at the base portion of the combustion cylinder 2A, a combustion inner pipe 6, which is secured to the base member 4 and extends upwardly, and a combustion outer pipe 7, which is located on the side outward from the combustion inner pipe 6 and at a predetermined spacing from the combustion inner pipe 6.

The base member 4 has a gas flow path **4*a*, which extends through the center portion of the base member 4. The bottom end of the base member 4 is fitted onto the top end of the nozzle 3. A radially-extending primary air hole 5 opens on opposite sides of the base member 4 and at a position above the bottom end of the base member 4**.

A flange **4*b* is formed at an intermediate portion of the outer periphery of the base member 4. The bottom end portion of the combustion inner pipe 6, in which the fuel gas containing the primary air mixed in flows, is fitted and secured onto the portion of the base member 4 above the flange 4*b*. The combustion inner pipe 6 and the combustion outer pipe 7, which is located on the side outward from the combustion inner pipe 6, constitute a double-pipe structure. The top end of the combustion outer pipe 7 protrudes upwardly beyond the top end of the combustion inner pipe 6. The bottom end of the combustion outer pipe 7 is located approximately at the same position as the position of the bottom end of the combustion inner pipe 6. The space, which is defined between the outer surface of the combustion inner pipe 6 and the inner surface of the combustion outer pipe 7, is formed as a secondary air flow path S, through which secondary air is supplied to a combustion flame. The combustion inner pipe 6 and the combustion outer pipe 7** are coupled together by a coupling member (not shown).

Figure 3:
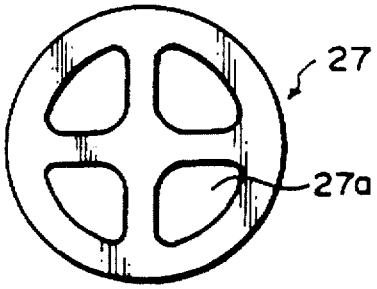
FIG. 3 is a plan view showing an eddy flow plate.

An eddy flow plate 27 and a metal mesh member 28 are placed on the top end of the base member 4 and are thus interposed in the gas flow path **4*a*. As illustrated in FIG. 3, the eddy flow plate 27 is constituted of a metal disk having apertures 27*a*, 27*a*, . . . The eddy flow plate 27 produces a turbulent flow in of the fuel gas flow and thereby enhances the mixing of the fuel gas and the primary air. The metal mesh member 28** is constituted of circular wire gauze and prevents a back flow of the flame.

Reverting to FIG. 1, the operation member 15 is supported by being associated with the piezo-electric unit 14 such that the operation member 15 can slide downwardly. An electrical discharge electrode 29, which is connected to the piezo-electric unit 14, is located along a side of the operation member 15. The electrical discharge electrode 29 is held by an electrode holder 30, which extends through the side walls of the combustion outer pipe 7 and the combustion inner pipe 6 of the combustion cylinder 2A, such that an end of the electrical discharge electrode 29 may stand facing the area inside of the combustion inner pipe 6.

An outer peripheral portion of the base member 4 of the combustion cylinder 2A, which portion is located above the primary air hole 5, is engaged with and supported by the inner housing 16. The base member 4 is thus supported together with the combustion inner pipe 6 and the combustion outer pipe 7. The combustion cylinder 2A is associated with the electrical discharge electrode 29 and the electrode holder 30, and a cover 31 is located on the outward side of the electrode holder 30. The combustion cylinder 2A is secured in this manner. These members are assembled together with the piezo-electric unit 14 and the operation member 15 by the inner housing 16. The assembly is assembled to the tank body 11. Therefore, the assembling process can be kept simple.

A coiled flame reaction member 33 having a flame reaction agent is located in the vicinity of the top end of the combustion outer pipe 7 of the combustion cylinder 2A. The flame reaction member 33 is located in the area inside of the combustion outer pipe 7, in the area inside of the combustion inner pipe 6, or in the vicinity of the top end of the combustion outer pipe 7 or the combustion inner pipe 6. In lieu of the flame reaction member 33, a catalyst member carrying a reaction catalyst, such as Pt, may be used. A decorative ring 34 is fitted to the outer periphery of the top end portion of the combustion outer pipe 7.

In the combustion device 1 constructed in the manner described above, when the cover 17 is opened and the operation member 15 is pushed down, the lever push piece 15*a* of the operation member 15 causes the actuating lever 19 to rotate. The nozzle 3 is thus moved up by the actuating lever 19. As a result, the fuel gas is jetted from the jet opening 3*a* of the nozzle 3. The primary air is introduced from the primary air hole 5, which opens through the side wall of the base member 4 of the combustion cylinder 2A, by the effects of a negative pressure, which is produced by the flow velocity and the flow rate of the fuel gas being jetted from the nozzle 3. The primary air having been introduced from the primary air hole 5 is mixed with the jetted fuel gas. The primary air and the fuel gas pass through the metal mesh member 28 for preventing a back flow of the flame and thereafter stirred and mixed together by the eddy flow plate 27. The resulting mixed gas flows upwardly in the combustion inner pipe 6.

When the operation member 15 is pushed down even further, the piezo-electric unit 14 is actuated by the operation member 15. In this manner, a high voltage for electrical discharge is applied to the electrical discharge electrode 29, discharge is caused to occur, and the mixed gas is lighted and burned. The position, at which a high-temperature portion of the flame occurring from the combustion is located, is determined by the mixing ratio of the primary air and the fuel gas and the flow velocity of the mixed gas. It is favorable that the flame reaction member 33 or the catalyst described above is located at the position of the high-temperature portion of the flame.

The combustion flame extends upwardly beyond the combustion inner pipe 6. At the top end of the combustion inner pipe 6, the secondary air having flowed upwardly through the secondary air flow path S, which is formed between the combustion inner pipe 6 and the combustion outer pipe 7, is introduced and mixed into the combustion flame. Therefore, stable combustion can continue. Further, the ambient air mixes into the combustion flame at the top end of the combustion outer pipe 7 and contributes to the combustion.

The gas flow rate, the amount of the primary air introduced, and the amount of the secondary air introduced are set such that the internal combustion may occur (as illustrated in FIG. 5B 5C, or 5D) wherein a portion of the combustion flame is produced on the side inward from the top end of the combustion outer pipe 7. The gas flow rate is determined by the diameter of the jet opening of the nozzle 3. The amount of the primary air introduced is determined by the diameter of the opening of the primary air hole 5, the gas flow rate, and the gas flow velocity. The amount of the secondary air introduced is determined by the length of the combustion outer pipe 7, the distance between the combustion inner pipe 6 and the combustion outer pipe 7, and the like.

In cases where the flame reaction member 33 or the catalyst is located in the area inside of the combustion inner pipe 6 or is located at the upper end of the combustion inner pipe 6 and in the area inside of the combustion outer pipe 7, the flame reaction member 33 or the catalyst comes into contact with the high-temperature portion of the combustion flame. In such cases, the flame reaction agent of the flame reaction member 33 is quickly heated at a temperature not lower than the temperature, at which a flame reaction can occur. As a result, a flame having a color corresponding to the kind of the flame reaction agent can be obtained quickly. Also, the catalyst can be heated due to the combustion of the fuel gas at a temperature not lower than the temperature, at which a catalytic reaction can begin. As a result, even if the flame is blown off by wind coming from the exterior and goes out, the mixed gas can be lighted again when it passes through the catalyst.

FIG. 4 shows an example of a state of combustion with the combustion cylinder 2A having the double-pipe structure in the first embodiment described above. In FIG. 4, the relationship between the area of the opening of the primary air hole 5, i.e. the amount of the primary air introduced, and the flow rate of the fuel gas jetted from the nozzle 3. FIGS. 5A through 5E are explanatory views showing various states of combustion. In FIGS. 5A through 5E, (A) through (E) represent the measuring points (A) through (E) shown in FIG. 4. At the measuring points (A) through (E), the area of the opening of the primary air hole 5 is kept at a predetermined value, and the gas flow rate is increased successively from the measuring point (A) to the measuring point (E).

In FIG. 4, the region, which is surrounded by the solid line al and hatched with the lines inclined upwards to the left, represents the internal combustion region. In the internal combustion region, as illustrated in FIGS. 5B, 5C, and 5D, combustion occurs such that a portion of the flame may be produced on the side inward from the top end of the combustion outer pipe 7. An inner flame f, which extends from the flame portion inside of the combustion outer pipe 7 to the bottom of the flame portion outside of the combustion outer pipe 7, is blue. An outer flame g, which is produced at the upper part, is approximately transparent and undergoes perfect combustion. In the state of combustion shown in FIG. 5B, the gas flow rate is comparatively low. As the gas flow rate increases successively, the flame becomes vertically longer as illustrated in FIGS. 5C and 5D.

The region, which is shown on the left side in FIG. 4 and is not hatched, represents an external combustion region. In the external combustion region, as illustrated in FIG. 5A, a flame is produced only on the side outward from the top end of the combustion outer pipe 7 and undergoes perfect combustion. The external combustion occurs in the region in which the gas flow rate is low. The region, which is hatched with the lines inclined upwards to the right in FIG. 4, represents a lifting combustion region. In the lifting combustion region, as illustrated in FIG. 5E, a combustion flame is produced only at a position spaced away from the top end of the combustion outer pipe 7. The lifting combustion occurs in a state, in which the gas flow velocity is higher than the rate of combustion of the fuel gas, and in the region in which the amount of the primary air introduced is comparatively small as compared with the gas flow rate. The region, which is shown on the lower right side in FIG. 4 and is not hatched, represents a yellow tip combustion region. In the yellow tip combustion region, though not shown, a flame occurring upwardly from the top end of the combustion outer pipe 7 as shown in FIG. 5A elongates vertically, and the tip of an inner flame contains a red-yellow imperfect combustion portion. The yellow tip combustion occurs in the region, in which the amount of the primary air introduced is particularly small and the gas flow rate is high.

In the example of the results of measurements shown in FIG. 4, the dimensions of the combustion cylinder 2A are such that the diameter of the jet opening of the nozzle 3 is 50 μm, the inner diameter of the combustion inner pipe 6 is 5.7 mm, the wall thickness of the combustion inner pipe 6 is 0.4 mm, and the height of the combustion inner pipe 6, including the flange 4*b*, is 12 mm. Also, the inner diameter of the combustion outer pipe 7 is 6.5 mm, the wall thickness of the combustion outer pipe 7 is 0.3 mm, the height of the combustion outer pipe 7 is 15 mm, and the amount of protrusion of the top end of the combustion outer pipe 7 from the top end of the combustion inner pipe 6 is 3 mm. The distance between the outer surface of the combustion inner pipe 6 and the inner surface of the combustion outer pipe 7 is 0.7 mm.

Figure 20:
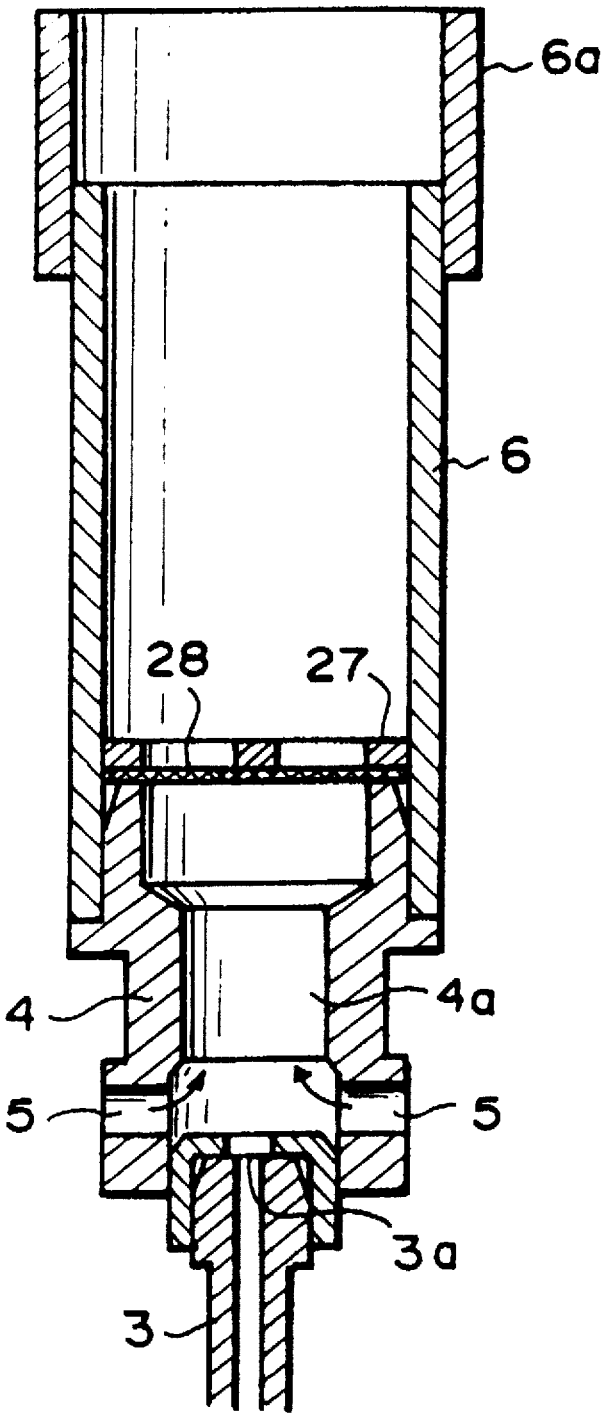
FIG. 20 is a sectional view showing a combustion cylinder in a comparative example.

The region, which is surrounded by the chained line a2 in FIG. 4, is the internal combustion region, which is obtained with a combustion cylinder having a single-pipe structure shown in FIG. 20 and serving as a comparative example. In the single-pipe structure shown in FIG. 20, an extension pipe 6*a* is secured to the top end of a combustion inner pipe 6, and the combustion inner pipe 6 is fitted onto a base member 4, which is the same as the base member 4 shown in FIG. 2. A fuel gas is burned by being mixed with only the primary air, which has been introduced through a primary air hole 5 formed at the bottom portion of the base member 4. The other features of the structure are the same as those of the structure shown in FIG. 2. In FIG. 20, similar elements are numbered with the same reference numerals with respect to FIG. 2.

The internal combustion region, which is obtained with the combustion cylinder having the single-pipe structure shown in FIG. 20, is narrower than the internal combustion region obtained with the first embodiment of the combustion device in accordance with the present invention. In particular, in the region, in which the gas flow rate is high and the area of the primary air hole 5 is small, the state of combustion is apt to shift from the internal combustion to the lifting combustion. With the first embodiment of the combustion device in accordance with the present invention, the internal combustion can be obtained even in the region, in which the gas flow rate is high and the area of the primary air hole 5 is small. Also, with the combustion cylinder having the single-pipe structure shown in FIG. 20, in the region in which the gas flow rate is low, the state of combustion is apt to shift from the internal combustion to the external combustion. In other words, with the first embodiment of the combustion device in accordance with the present invention, in cases where the area of the primary air hole 5 is set to be a specific value for obtaining the internal combustion, the range of the gas flow rate, in which the internal combustion can be kept even if the gas flow rate fluctuates, can be kept broad.

In particular, the valve mechanism 12 shown in FIG. 1 is provided with the gas flow rate adjusting filter 23. Thus the valve mechanism 12 has the adjusting function such that, even if the internal pressure in the tank fluctuates, the gas flow rate can be kept approximately constant. Therefore, with the first embodiment of the combustion device in accordance with the present invention, the width of fluctuation of the gas flow rate can be kept small, and the internal combustion can be obtained reliably. Accordingly, a particular operation for adjusting the gas flow rate is not required.

In lieu of the valve mechanism 12 provided with the gas flow rate adjusting filter 23, a known valve mechanism, which does not have the flow rate adjusting function, such as a valve mechanism having a filter for merely serving to vaporize a fuel gas, or a valve mechanism provided with a filter constituted of a film having pores, may be employed.

Figure 6:
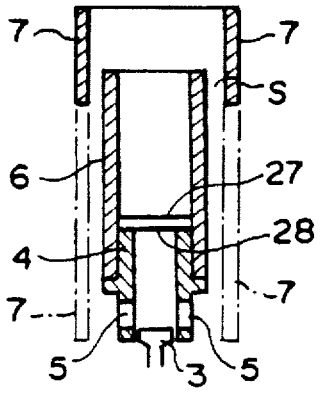
FIG. 6 is a schematic sectional view showing a combustion cylinder in a modification of the first embodiment of the combustion device in accordance with the present invention.
Figure 7:
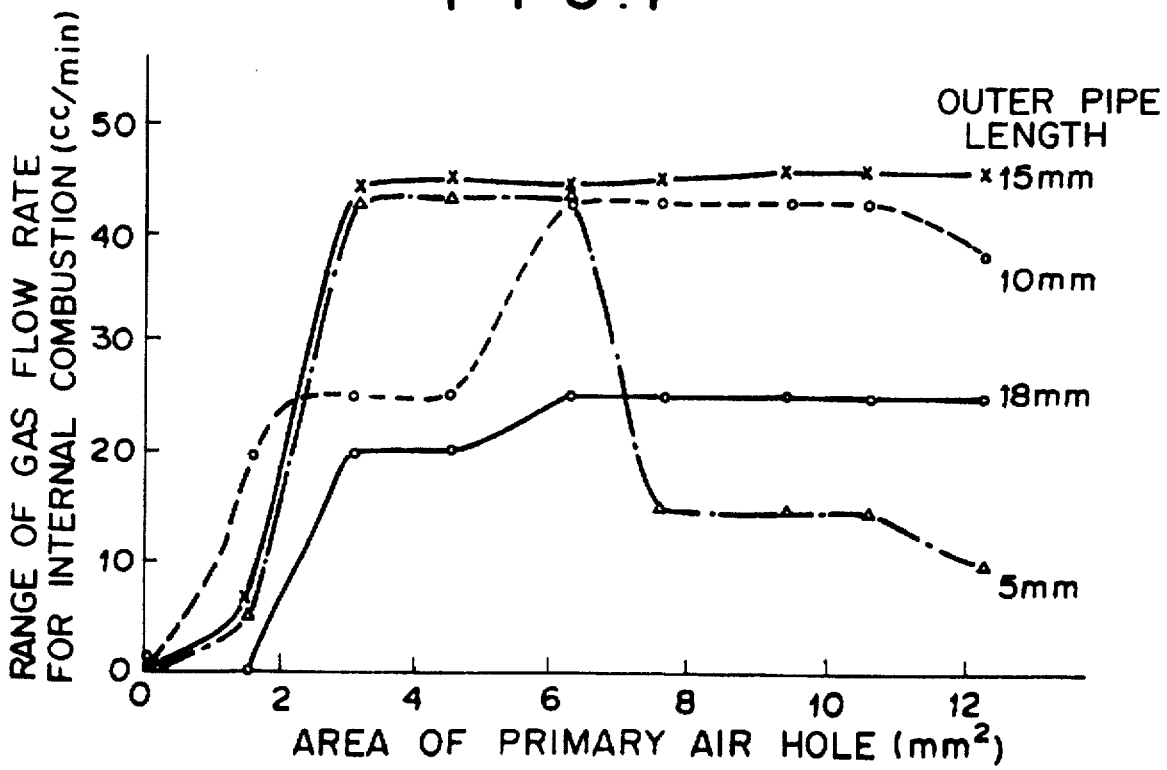
FIG. 7 is a graph showing combustion characteristics with respect to various lengths of combustion outer pipes in the first embodiment of the combustion device in accordance with the present invention.

FIG. 6 shows a combustion cylinder in a modification of the first embodiment of the combustion device in accordance with the present invention. In FIG. 6, the length of the combustion outer pipe 7 is changed by altering the position of the bottom end of the combustion outer pipe 7. The length of the combustion outer pipe 7 was successively altered from a length of 5 mm as indicated by the solid line in FIG. 6 to a length of 18 mm, which is indicated by the chained line and which extends to a side of the primary air hole 5, and the measurements of the state of combustion were carried out in the same manner as that described above with reference to FIG. 4. FIG. 7 shows the results of the measurements concerning the effects of the alteration of the length (the position of the bottom end) of the combustion outer pipe 7 in the double-pipe structure shown in FIG. 6 upon the state of combustion. Specifically, FIG. 7 shows the range of the gas flow rate, in which the internal combustion can occur, with respect to the area of the opening of the primary air hole 5. A broader gas flow rate range indicates that the internal combustion can be obtained more stably. In the measurements described above, the distance between the outer surface of the combustion inner pipe 6 and the inner surface of the combustion outer pipe 7 was 0.7 mm.

From the results shown in FIG. 7, it has been found that the length (the position of the bottom end) of the combustion outer pipe 7 has a large correlation with the range of the gas flow rate, in which the internal combustion can occur. In cases where the length of the combustion outer pipe 7 is 15 mm as in the first embodiment described above, the range of the gas flow rate, in which the internal combustion can occur, can be kept broad regardless of the size of the primary air hole 5. In cases where the length of the combustion outer pipe 7 is 18 mm, the range of the gas flow rate, in which the internal combustion can occur, is comparatively narrow. This will presumably because the combustion outer pipe 7 extends to the side of the primary air hole 5 and obstructs the introduction of the primary air.

As for the position of the top end of the combustion outer pipe 7, combustion experiments were carried out in the same manner as that described above by altering the position of the top end of the combustion outer pipe 7 to a position, which is lower than the position of the top end of the combustion inner pipe 6, to the same position as the position of the top end of the combustion inner pipe 6, and to the position protruding upwardly beyond the position of the top end of the combustion inner pipe 6. From the results (not shown) of the combustion experiments, it has been found that, in cases where the top end of the combustion outer pipe 7 is located at the same height as the height of the top end of the combustion inner pipe 6 (i.e., in cases where the amount of protrusion of the top end of the combustion outer pipe 7 from the top end of the combustion inner pipe 6 is ±0 mm), the secondary air is favorably supplied from the secondary air flow path S, which is formed between the combustion inner pipe 6 and the combustion outer pipe 7, and the range of the gas flow rate, in which the internal combustion can occur, becomes broader than when the amount of protrusion of the top end of the combustion outer pipe 7 from the top end of the combustion inner pipe 6 is +3 mm as in the aforesaid embodiment shown in FIG. 2. However, in cases where the top end of the combustion outer pipe 7 is lower than the top end of the combustion inner pipe 6 (in cases where the amount of protrusion of the top end of the combustion outer pipe 7 from the top end of the combustion inner pipe 6 is, for example, −3 mm), the amount of the secondary air introduced becomes insufficient, and the state of combustion is apt to shift to the lifting combustion in the region in which the gas flow rate is high. Thus in such cases, the range of the gas flow rate, in which the internal combustion can occur, becomes narrow. Therefore, in the combustion device in accordance with the present invention, the top end of the combustion outer pipe 7 is formed at a position, which falls within the range of from the same position as the position of the top end of the combustion inner pipe 6 to a position protruding beyond the top end of the combustion inner pipe 6.

Combustion experiments were further carried out by altering the distance from the outer surface of the combustion inner pipe 6 to the inner surface of the combustion outer pipe 7 in the combustion cylinder 2A having the double-pipe structure described above. From the results of the combustion experiments, a large correlation as in the correlation between the length of the combustion outer pipe 7 and the range of the gas flow rate, in which the internal combustion can occur, was not found between the distance from the outer surface of the combustion inner pipe 6 to the inner surface of the combustion outer pipe 7 and the range of the gas flow rate, in which the internal combustion can occur.

<Second embodiment>

Figure 8:
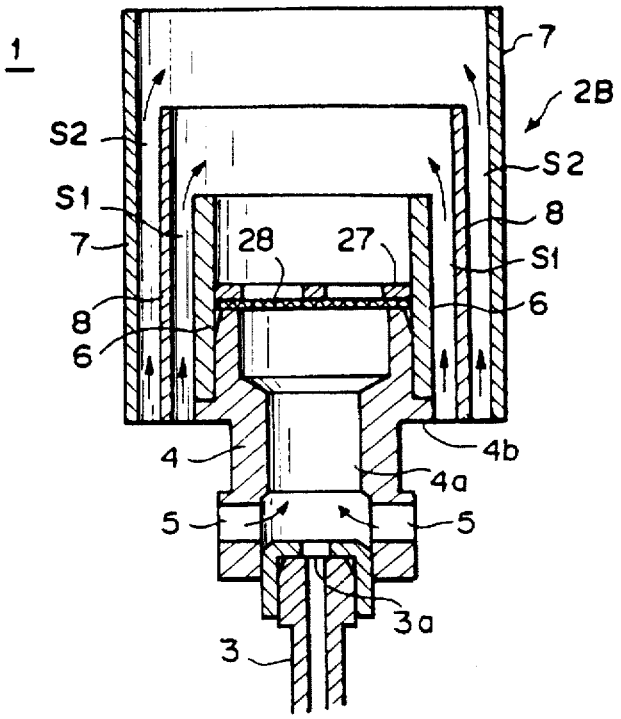
FIG. 8 is a sectional view showing a combustion cylinder in a second embodiment of the combustion device in accordance with the present invention.

FIG. 8 shows a combustion cylinder 2B in a second embodiment of the combustion device in accordance with the present invention. The combustion cylinder 2B has a triple-pipe structure.

In the second embodiment, the combustion cylinder 2B comprises the base member 4, into which the top end of the same nozzle 3 as the nozzle 3 in the first embodiment describe above is fitted and which has the primary air hole 5. The combustion inner pipe 6 is secured to the base member 4. The combustion outer pipe 7 is located on the side outward from the combustion inner pipe 6 and at a predetermined spacing from the combustion inner pipe 6. Also, a combustion intermediate pipe 8 is located between the combustion inner pipe 6 and the combustion outer pipe 7. A triple-pipe structure is thereby formed. The top end of the combustion intermediate pipe 8 is lower than the top end of the combustion outer pipe 7 and protrudes upwardly beyond the top end of the combustion inner pipe 6. (Alternatively, the top end of the combustion intermediate pipe 8 may be located at the same height as the height of the combustion inner pipe 6 or the top end of the combustion outer pipe 7.) As a whole, the vertical length of the combustion cylinder 2B is shorter than the vertical length of the combustion cylinder 2A employed in the double-pipe structure of the first embodiment shown in FIG. 2. The other features of the structure of the combustion cylinder 2B are the same as those of the structure of the combustion cylinder 2A shown in FIG. 2. In FIG. 8, similar elements are numbered with the same reference numerals with respect to FIG. 2.

The space, which is defined between the combustion inner pipe 6 and the combustion intermediate pipe 8, is formed as a secondary air flow path S1. Also, the space, which is defined between the combustion intermediate pipe 8 and the combustion outer pipe 7, is formed as a secondary air flow path S2. By way of example, the dimensions of the combustion cylinder 2B are such that the diameter of the jet opening of the nozzle 3 is 50 μm, the inner diameter of the combustion inner pipe 6 is 5.7 mm, the wall thickness of the combustion inner pipe 6 is 0.45 mm, and the height of the combustion inner pipe 6, including the flange **4*b*, is 5.5 mm. Also, the inner diameter of the combustion intermediate pipe 8 is 7.4 mm, the wall thickness of the combustion intermediate pipe 8 is 0.2 mm, the height of the combustion intermediate pipe 8 is 9.0 mm, and the amount of protrusion of the top end of the combustion intermediate pipe 8 from the top end of the combustion inner pipe 6 is 3.5 mm. Further, the inner diameter of the combustion outer pipe 7 is 8.6 mm, the wall thickness of the combustion outer pipe 7 is 0.2 mm, the height of the combustion outer pipe 7 is 10 mm, and the amount of protrusion of the top end of the combustion outer pipe 7 from the top end of the combustion intermediate pipe 8 is 1 mm. The distance between the outer surface of the combustion inner pipe 6 and the inner surface of the combustion intermediate pipe 8 is 0.4 mm. The distance between the outer surface of the combustion intermediate pipe 8 and the inner surface of the combustion outer pipe 7** is 0.4 mm.

In the combustion cylinder 2B having the structure described above, when the fuel gas is jetted from the nozzle 3, the primary air is introduced from the primary air hole 5 and mixed with the jetted fuel gas. The primary air and the fuel gas pass through the metal mesh member 28 and the eddy flow plate 27 and are mixed together by the eddy flow plate 27. The resulting mixed gas flows upwardly and is lighted. At the top end of the combustion inner pipe 6, the secondary air having flowed upwardly through the secondary air flow path S1, which is formed between the combustion inner pipe 6 and the combustion intermediate pipe 8, is introduced and mixed into the combustion flame. Further, at the top end of the combustion intermediate pipe 8, the secondary air having flowed upwardly through the secondary air flow path S2, which is formed between the combustion intermediate pipe 8 and the combustion outer pipe 7, is introduced and mixed into the combustion flame. Therefore, stable combustion can continue.

Measurement was carried out in the same manner as that described above with reference to FIG. 4 to find the state of combustion with the combustion cylinder 2B. From the results of the measurements, it has been found that, as indicated by the broken line a3 in FIG. 4, the internal combustion region, in which the internal combustion can occur such that a portion of the combustion flame is produced on the side inward from the top end of the combustion outer pipe 7, can be broadened even further to the region in which the gas flow rate is higher than in the internal combustion region al. This is presumably because the secondary air is supplied in two steps with the triple-pipe structure, and therefore the internal combustion can be obtained even in the region, in which the amount of the primary air becomes insufficient.

Figure 9:
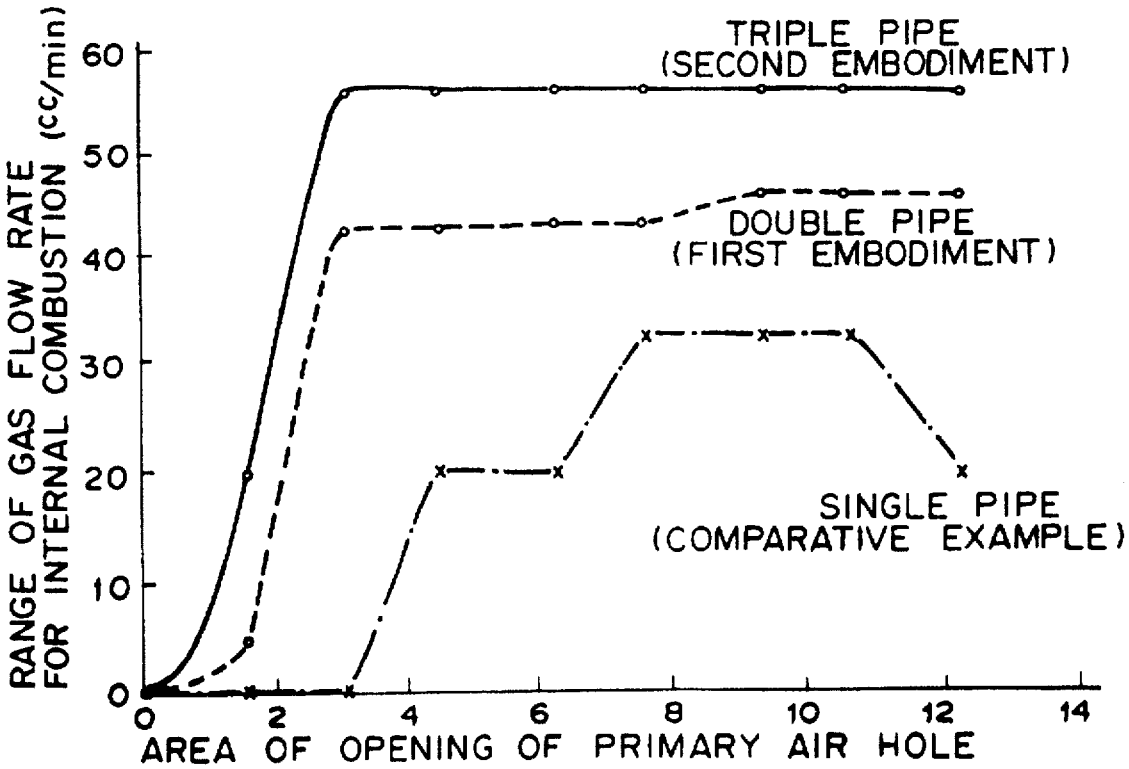
FIG. 9 is a graph showing combustion characteristics of the second embodiment of the combustion device in accordance with the present invention and a comparative example.

As for the triple-pipe structure in the second embodiment, the double-pipe structure in the first embodiment described above, and the single-pipe structure serving as the comparative example shown in FIG. 20, measurements were carried out to find the ranges of the gas flow rate, in which the internal combustion can occur, with respect to the area of the opening of the primary air hole 5. FIG. 9 shows the results of the measurements. As illustrated in FIG. 9, with the triple-pipe structure employed in the second embodiment, the range of the gas flow rate, in which the internal combustion can occur, becomes broader and the internal combustion becomes stabler with respect to a change in the area of the opening of the primary air hole 5 than in the double-pipe structure employed in the first embodiment described above.

<Third embodiment>

Figure 10:
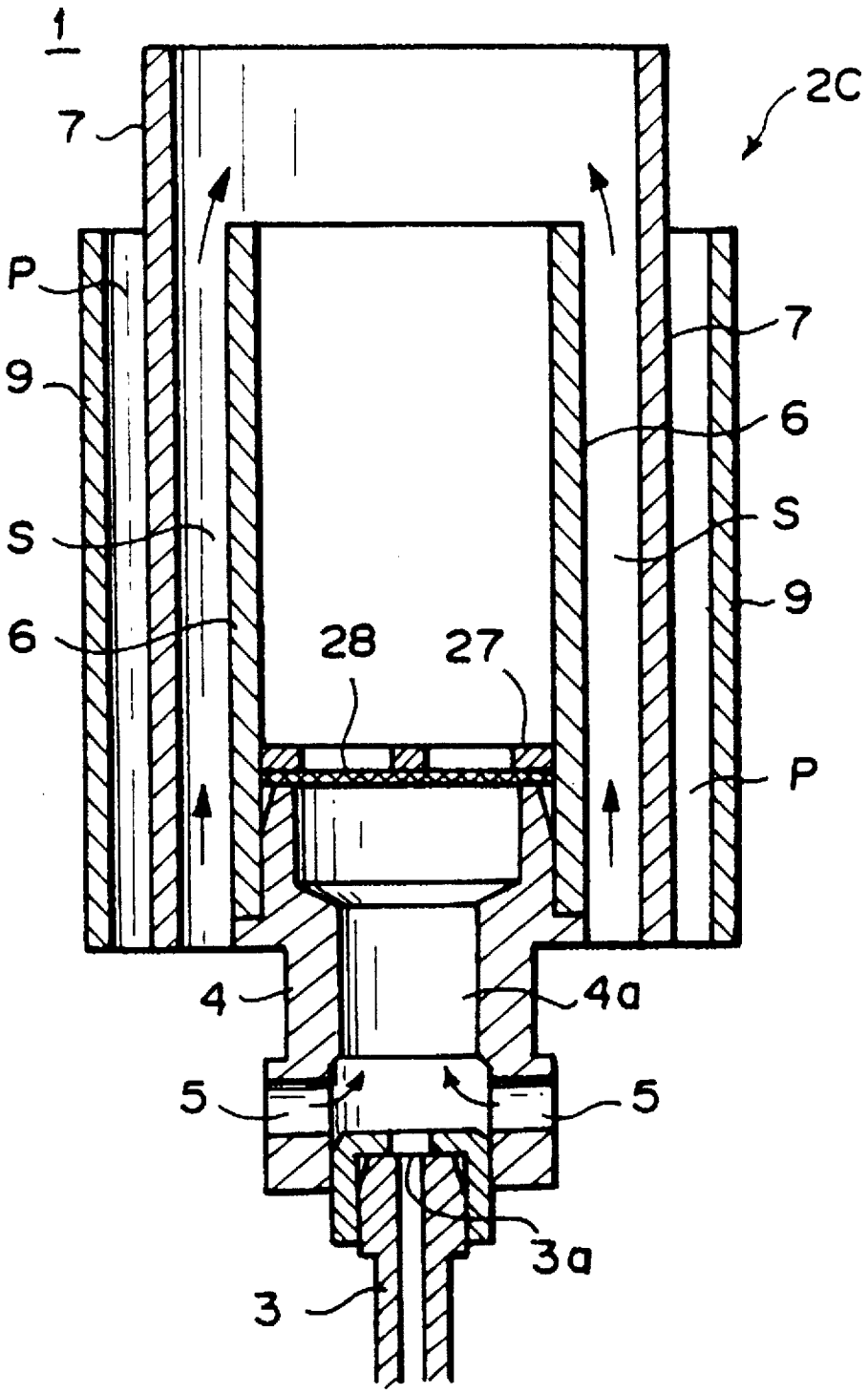
FIG. 10 is a sectional view showing a combustion cylinder in a third embodiment of the combustion device in accordance with the present invention.

FIG. 10 shows a combustion cylinder 2C in a third embodiment of the combustion device in accordance with the present invention. In the third embodiment, an auxiliary pipe 9 is located on the side outward from the combustion outer pipe 7 in the double-pipe structure employed in the first embodiment.

In the combustion cylinder 2C, the base member 4, the combustion inner pipe 6, and the combustion outer pipe 7 are constituted in the same manner as that in the first embodiment described above. The auxiliary pipe 9 is located around the outer periphery of the combustion outer pipe 7 and at a predetermined spacing from the combustion outer pipe 7. The top end of the auxiliary pipe 9 is lower than the top end of the combustion outer pipe 7 and is located approximately at the same height as the height of the combustion inner pipe 6.

In the third embodiment, the auxiliary pipe 9 does not contribute to the combustion. Air flows through the space P, which is defined between the combustion outer pipe 7 and the auxiliary pipe 9. When the fuel gas burns in the combustion cylinder 2C, the top end of the combustion outer pipe 7 is heated by the flame, heat at the top end of the combustion outer pipe 7 transfers downwardly, and the entire area of the combustion outer pipe 7 thereby becomes hot. At this time, heat from the combustion outer pipe 7 is blocked by air, which is present in the space P, which is defined between the combustion outer pipe 7 and the auxiliary pipe 9. Therefore, the temperature of the outer side surface of the combustion cylinder 2C can be prevented from increasing, and a countermeasure against heat can be kept simple with respect to a member for supporting the combustion cylinder 2C in the lighter, such as a gas lighter.

Figure 11:
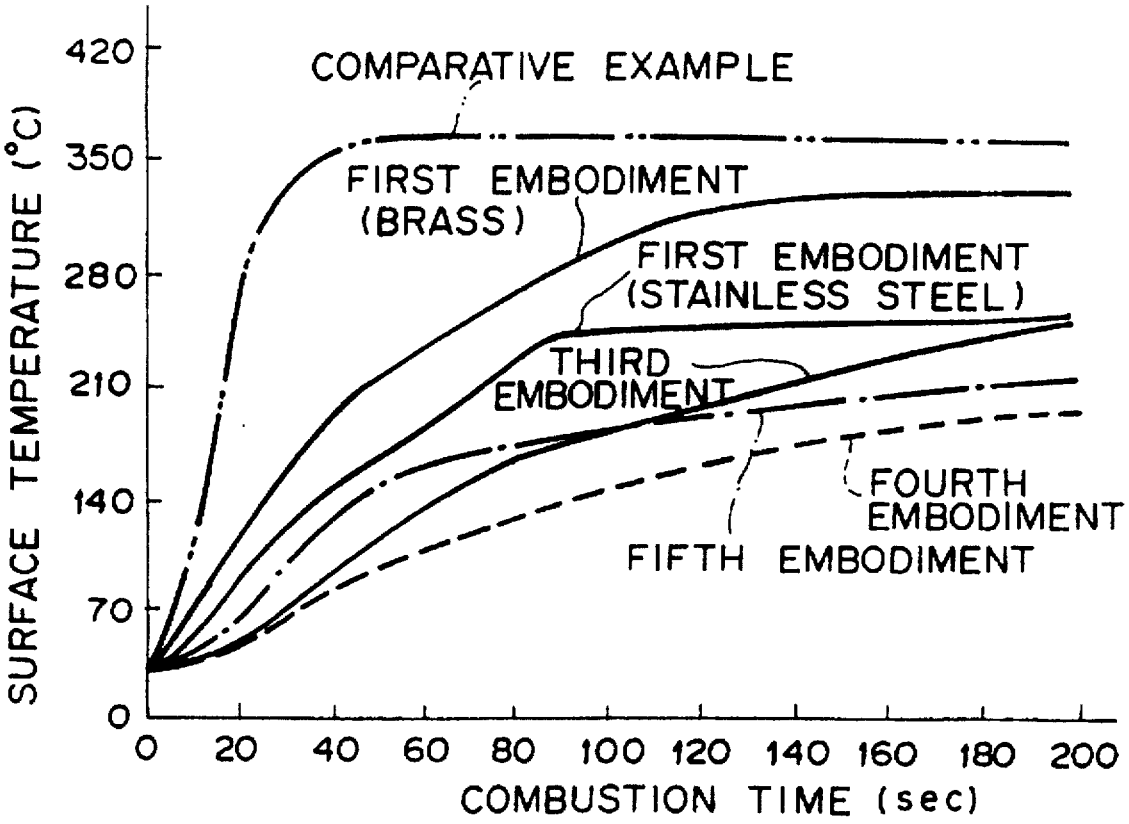
FIG. 11 is a graph showing combustion time vs. surface temperature change characteristics of the combustion cylinder in the third embodiment of the combustion device in accordance with the present invention.

Accordingly, the combustion cylinder 2C has the same combustion characteristics as those in the first embodiment described above and shown in FIG. 4. FIG. 11 shows combustion time vs. surface temperature change characteristics of the combustion cylinder 2C.

In the measurement of the surface temperature of the combustion cylinder 2C, a fuel gas was lighted in the standard condition of 25° C. and at an isobutane gas flow rate of 35 cc/min. Thereafter, the surface temperature of the combustion cylinder 2C was measured with respect to the passage of the combustion time. FIG. 11 shows the temperature rise characteristics of the combustion cylinder 2C employed in the third embodiment, the combustion cylinder 2A employed in the first embodiment and having the double-pipe structure (constituted of brass or stainless steel), the combustion cylinder having the single-pipe structure (constituted of stainless steel) serving as the comparative example, and combustion cylinders employed in fourth and fifth embodiments of the combustion device in accordance with the present invention, which will be described later.

As is found from FIG. 11, with the combustion cylinder 2C provided with the auxiliary pipe 9 and employed in the third embodiment, the temperature rise is slower and the surface temperature of the combustion cylinder 2C is lower than the combustion cylinders of the comparative example and the first embodiment. Also, with the combustion cylinder having the double-pipe structure and employed in the first embodiment, the temperature rise is slower than with the combustion cylinder having the single-pipe structure serving as the comparative example. As for the material of the combustion cylinder, the combustion cylinder constituted of stainless steel having a low thermal conductivity exhibits a slower temperature rise than the combustion cylinder constituted of brass. In cases where the combustion cylinder is utilized in the gas lighter 10 (a cigarette lighter), the time required to light a cigarette is several seconds. During the time of several seconds, the difference in the temperature rise between the embodiments of the present invention and the comparative example occurs particularly markedly.

<Fourth embodiment>

Figure 12:
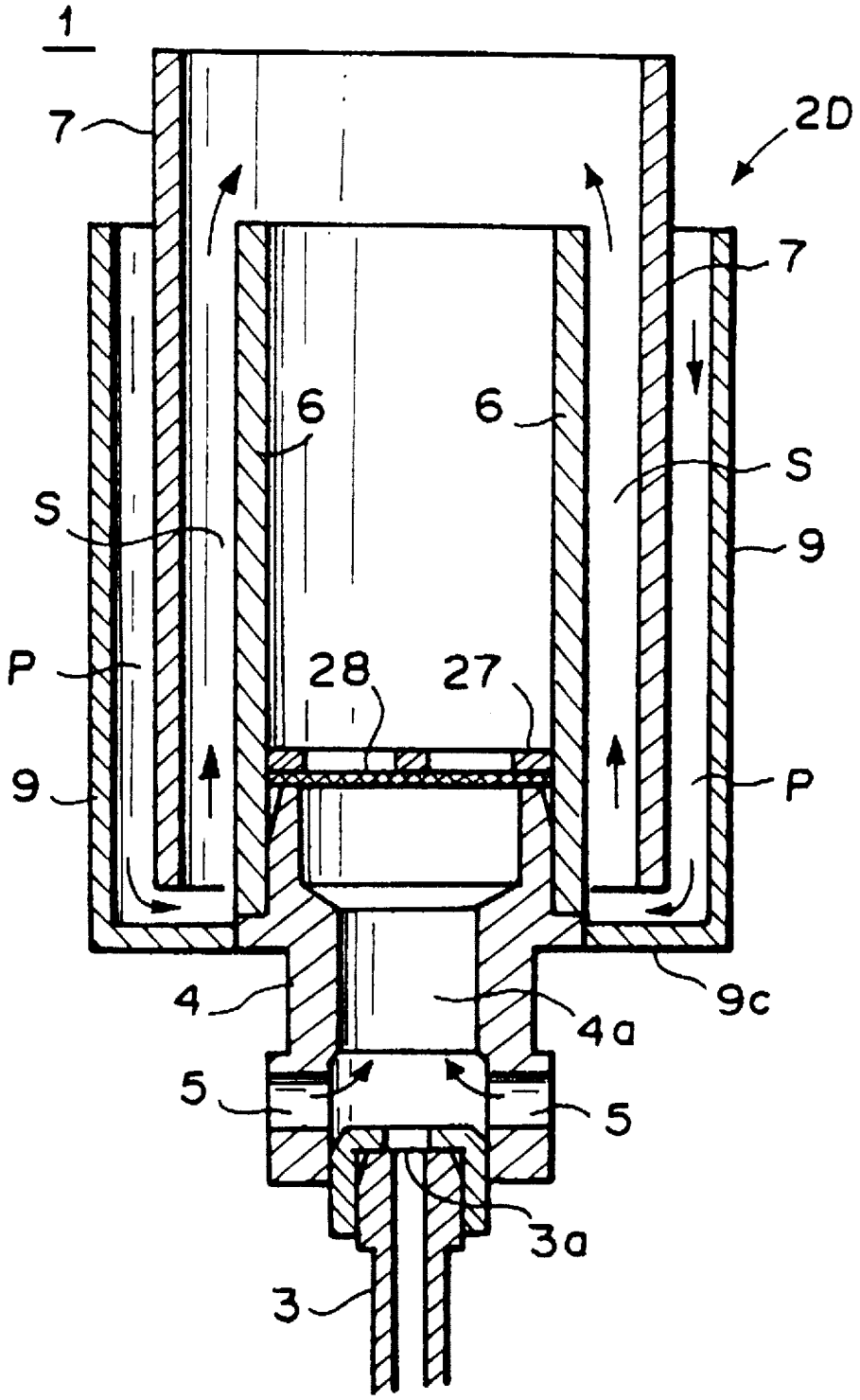
FIG. 12 is a sectional view showing a combustion cylinder in a fourth embodiment of the combustion device in accordance with the present invention.

FIG. 12 shows a combustion cylinder 2D in the fourth embodiment of the combustion device in accordance with the present invention. The structure of the combustion cylinder 2D is basically identical with the structure of the combustion cylinder 2C employed in the third embodiment shown in FIG. 10.

As in the combustion cylinder 2C employed in the third embodiment, the combustion cylinder 2D comprises the base member 4, the combustion inner pipe 6, the combustion outer pipe 7, and the auxiliary pipe 9. The bottom end of the auxiliary pipe 9 is bent inwardly and continues to a bottom wall **9*c*. The inner end of the bottom wall 9*c* is secured to the outer periphery of the flange 4*b* of the basemember 4**.

Specifically, the auxiliary pipe 9 and the combustion inner pipe 6 are coupled with each other. A path is formed under the bottom end of the combustion outer pipe 7 such that the side inward from the combustion outer pipe 7 and the side outward from the combustion outer pipe 7 may communicate with each other. In this manner, the path P, which is defined between the combustion outer pipe 7 and the auxiliary pipe 9, and the secondary air flow path S, which is defined between the combustion inner pipe 6 and the combustion outer pipe 7 communicate with each other. The secondary air is introduced from the open end (i.e., the top end) of the path P, which is defined between the combustion outer pipe 7 and the auxiliary pipe 9. The other features of the structure of the combustion cylinder 2D are the same as those of the structure of the combustion cylinder 2C employed in the third embodiment shown in FIG. 10.

In the fourth embodiment, the secondary air is introduced from the top end of the path P, which is defined between the combustion outer pipe 7 and the auxiliary pipe 9. The secondary air flows through the path P and thereafter flows upwardly through the secondary air flow path S, which is defined between the combustion inner pipe 6 and the combustion outer pipe 7. The secondary air is then supplied to the flame from the top end of the combustion inner pipe 6 and contributes to the combustion. In this case, the temperature of the combustion outer pipe 7 rises due to the combustion at the upper part of the region inside of the combustion outer pipe 7. However, the secondary air flowing through the path P and the secondary air flow path S restricts the rise in the temperature of the combustion outer pipe 7 and the auxiliary pipe 9.

In cases where the part for coupling the inner end of the bottom wall **9*c* of the auxiliary pipe 9 and the combustion inner pipe 6 with each other is constituted of a heat-insulating structure, the rise in the temperature of the outer side surface of the auxiliary pipe 9 can be restricted even further. The results of the measurements of the surface temperature of the auxiliary pipe 9 are indicated by the broken line in FIG. 11. As is clear from FIG. 11**, the surface temperature of the combustion cylinder can be restricted even further.

<Fifth embodiment>

Figure 13:
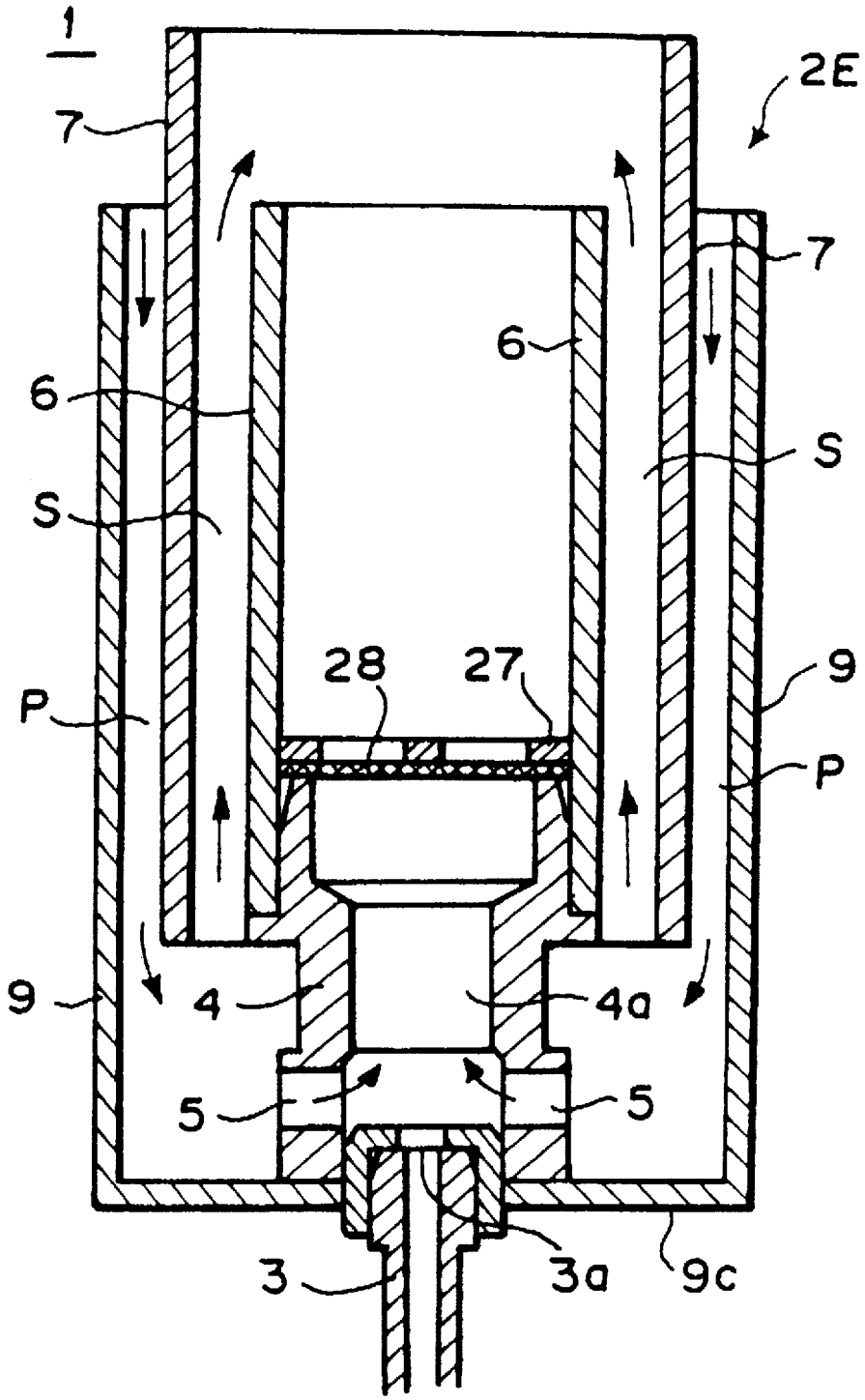
FIG. 13 is a sectional view showing a combustion cylinder in a fifth embodiment of the combustion device in accordance with the present invention.

FIG. 13 shows a combustion cylinder 2E in the fifth embodiment of the combustion device in accordance with the present invention. The structure of the combustion cylinder 2E is basically identical with the structure of the combustion cylinder 2C employed in the third embodiment.

As in the combustion cylinder 2C employed in the third embodiment, the combustion cylinder 2E comprises the base member 4, the combustion inner pipe 6, the combustion outer pipe 7, and the auxiliary pipe 9. The bottom end of the auxiliary pipe 9 is extended downwardly, is bent inwardly at a position below the primary air hole 5 of the base member 4, and continues to a bottom wall **9*c*. The inner end of the bottom wall 9*c* is secured to the bottom of the base member 4**.

Specifically, the path P, which is defined between the combustion outer pipe 7 and the auxiliary pipe 9, and the secondary air flow path S, which is defined between the combustion inner pipe 6 and the combustion outer pipe 7 communicate with each other. The path P also communicates with the primary air hole 5. The primary air and the secondary air are introduced from the open end (i.e., the top end) of the path P, which is defined between the combustion outer pipe 7 and the auxiliary pipe 9. The other features of the structure of the combustion cylinder 2E are the same as those of the structure of the combustion cylinder 2C employed in the third embodiment shown in FIG. 10.

With the fifth embodiment, approximately the same combustion state as the combustion state with the first, third, and fourth embodiments can be obtained. The primary air and the secondary air are introduced from the top end of the path P, which is defined between the combustion outer pipe 7 and the auxiliary pipe 9. The primary air and the secondary air flow through the path P. Thereafter, the primary air flows through the primary air hole 5. The secondary air flows upwardly through the secondary air flow path S, which is defined between the combustion inner pipe 6 and the combustion outer pipe 7. The secondary air is then supplied to the flame from the top end of the combustion inner pipe 6 and contributes to the combustion.

Also, the by the flow of the air described above, the rise in the temperature is restricted, and the temperature of the outer side surface of the auxiliary pipe 9 is kept low. The results of the measurements of the surface temperature of the auxiliary pipe 9 are indicated by the chained line in FIG. 11. As illustrated in FIG. 11, good results can be obtained.

<Sixth embodiment>

Figure 14:
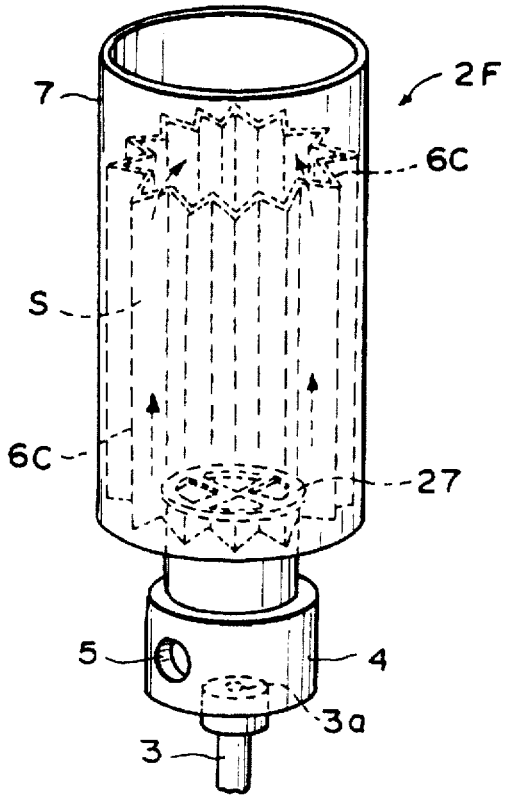
FIG. 14 is a sectional view showing a combustion cylinder in a sixth embodiment of the combustion device in accordance with the present invention.

FIG. 14 shows a combustion cylinder 2F in a sixth embodiment of the combustion device in accordance with the present invention. The structure of the combustion cylinder 2F is basically identical with the structure of the combustion cylinder 2A employed in the first embodiment.

The combustion cylinder 2F employed in the sixth embodiment has the same double-pipe structure as that shown in FIG. 2, except that a combustion inner pipe 6C, which is constituted of a pipe body formed of a corrugated sheet, is employed in lieu of the combustion inner pipe 6. Specifically, as viewed from above, the corrugated-sheet combustion inner pipe 6C is successively bent in a triangular wave-like pattern. Outer peripheral, vertically extending sides of the corrugated-sheet combustion inner pipe 6C are brought into contact with the inner surface of the combustion outer pipe 7 in order to secure the combustion outer pipe 7. Approximately triangular prism-like spaces are formed between the outer surface of the corrugated-sheet combustion inner pipe 6C and the inner surface of the combustion outer pipe 7. The approximately triangular prism-like spaces serve as the secondary air flow path S, through which the secondary air flows upwardly. The secondary air having flowed upwardly through the secondary air flow path S is supplied from the top end of the corrugated-sheet combustion inner pipe 6C to the flame.

The triangular spaces, which occur at the bottom of the inner surface of the corrugated-sheet combustion inner pipe 6C with respect to the base member 4, are closed such that no air may be sucked in from the triangular spaces at the bottom of the inner surface of the corrugated-sheet combustion inner pipe 6C.

In the sixth embodiment, approximately the same combustion state as that in the first embodiment described above can be obtained. Also, with the sixth embodiment, the assembling and support structure of the combustion cylinder 2F can be kept simple.

<Seventh embodiment>

Figure 15:
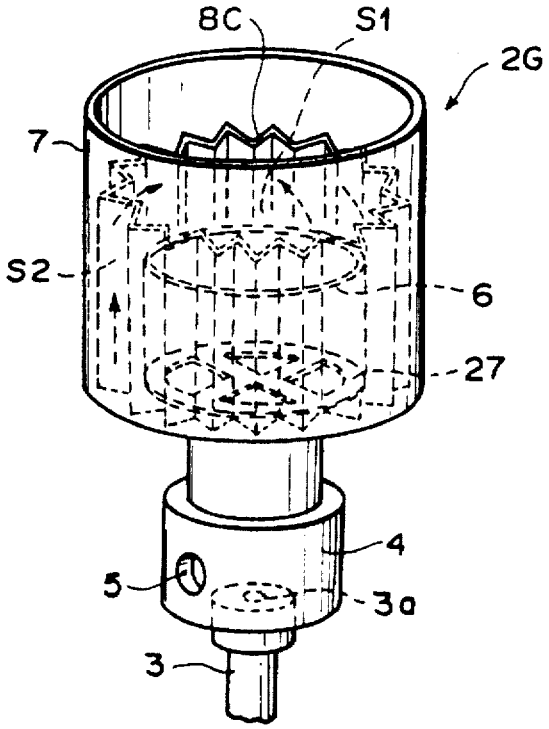
FIG. 15 is a sectional view showing a combustion cylinder in a seventh embodiment of the combustion device in accordance with the present invention.

FIG. 15 shows a combustion cylinder 2G in a seventh embodiment of the combustion device in accordance with the present invention. The structure of the combustion cylinder 2G is basically identical with the structure of the combustion cylinder 2B employed in the second embodiment shown in FIG. 8.

The combustion cylinder 2G employed in the seventh embodiment has the same triple-pipe structure as that shown in FIG. 8, except that a combustion intermediate pipe 8C, which is constituted of a pipe body formed of a corrugated sheet as in the corrugated-sheet combustion inner pipe 6C described above, is employed in lieu of the combustion intermediate pipe 8. Specifically, as viewed from above, the corrugated-sheet combustion intermediate pipe 8C is successively bent in a triangular wave-like pattern. Outer peripheral, vertically extending sides of the corrugated-sheet combustion intermediate pipe 8C are brought into contact with the inner surface of the combustion outer pipe 7. Also, vertically extending sides of the inner surface of the corrugated-sheet combustion intermediate pipe 8C are brought into contact with the outer surface of the combustion inner pipe 6. The triple-pipe structure is secured in this manner. Approximately triangular prism-like spaces, which are formed between the outer surface of the combustion inner pipe 6 and the inner surface of the corrugated-sheet combustion intermediate pipe 8C, serve as the secondary air flow path S1, through which the secondary air flows upwardly. The secondary air having flowed upwardly through the secondary air flow path S1 is supplied from the top end of the combustion inner pipe 6 to the flame. Also, approximately triangular prism-like spaces, which are formed between the outer surface of the corrugated-sheet combustion intermediate pipe 8C and the inner surface of the combustion outer pipe 7, serve as the secondary air flow path S2, through which the secondary air flows upwardly. The secondary air having flowed upwardly through the secondary air flow path S2 is supplied from the top end of the corrugated-sheet combustion intermediate pipe 8C to the flame.

<Eighth embodiment>

Figure 16:
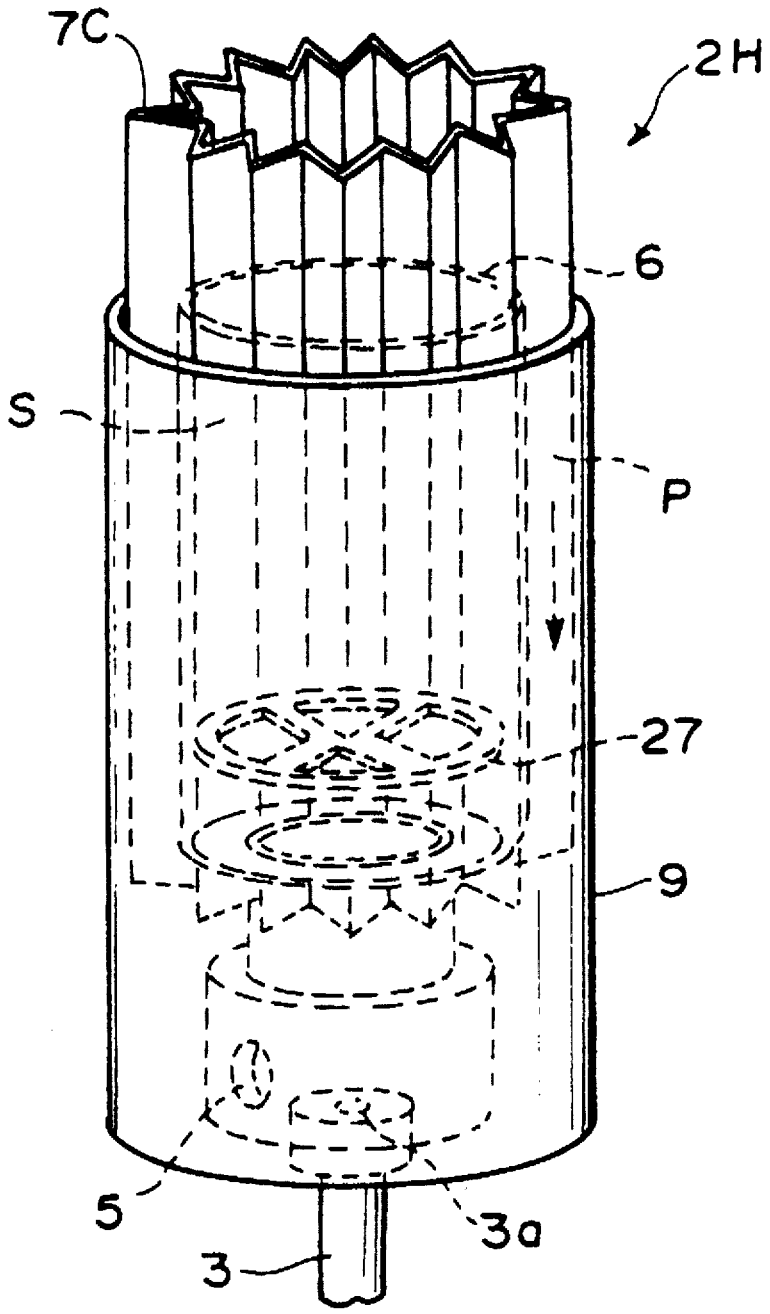
FIG. 16 is a sectional view showing a combustion cylinder in an eighth embodiment of the combustion device in accordance with the present invention.

FIG. 16 shows a combustion cylinder 2H in an eighth embodiment of the combustion device in accordance with the present invention. The structure of the combustion cylinder 2H is basically identical with the structure of the combustion cylinder 2E employed in the fifth embodiment shown in FIG. 13.

The combustion cylinder 2H employed in the eighth embodiment has the same structure as the structure shown in FIG. 13 and provided with the auxiliary pipe 9, except that a combustion outer pipe 7C, which is constituted of a pipe body formed of a corrugated sheet as described above, is employed in lieu of the combustion outer pipe 7. Specifically, outer peripheral, vertically extending sides of the corrugated-sheet combustion outer pipe 7C are brought into contact with the inner surface of the auxiliary pipe 9. Also, vertically extending sides of the inner surface of the corrugated-sheet combustion outer pipe 7C are brought into contact with the outer surface of the combustion inner pipe 6. Approximately triangular prism-like spaces, which are formed between the outer surface of the combustion inner pipe 6 and the inner surface of the corrugated-sheet combustion outer pipe 7C, serve as the secondary air flow path S, through which the secondary air flows upwardly. The secondary air having flowed upwardly through the secondary air flow path S is supplied from the top end of the combustion inner pipe 6 to the flame. Also, approximately triangular prism-like spaces, which are formed between the outer surface of the corrugated-sheet combustion outer pipe 7C and the inner surface of the auxiliary pipe 9, serve as the path P, through which the primary air and the secondary air are introduced.

In the combustion cylinder 2C shown in FIG. 10, which is employed in the third embodiment, and the combustion cylinder 2D shown in FIG. 12, which is employed in the fourth embodiment, the combustion outer pipe 7, which is located between the combustion inner pipe 6 and the auxiliary pipe 9, may be constituted of a cylindrical corrugated sheet of the same type as that described above.

<Ninth embodiment>

Figure 17:
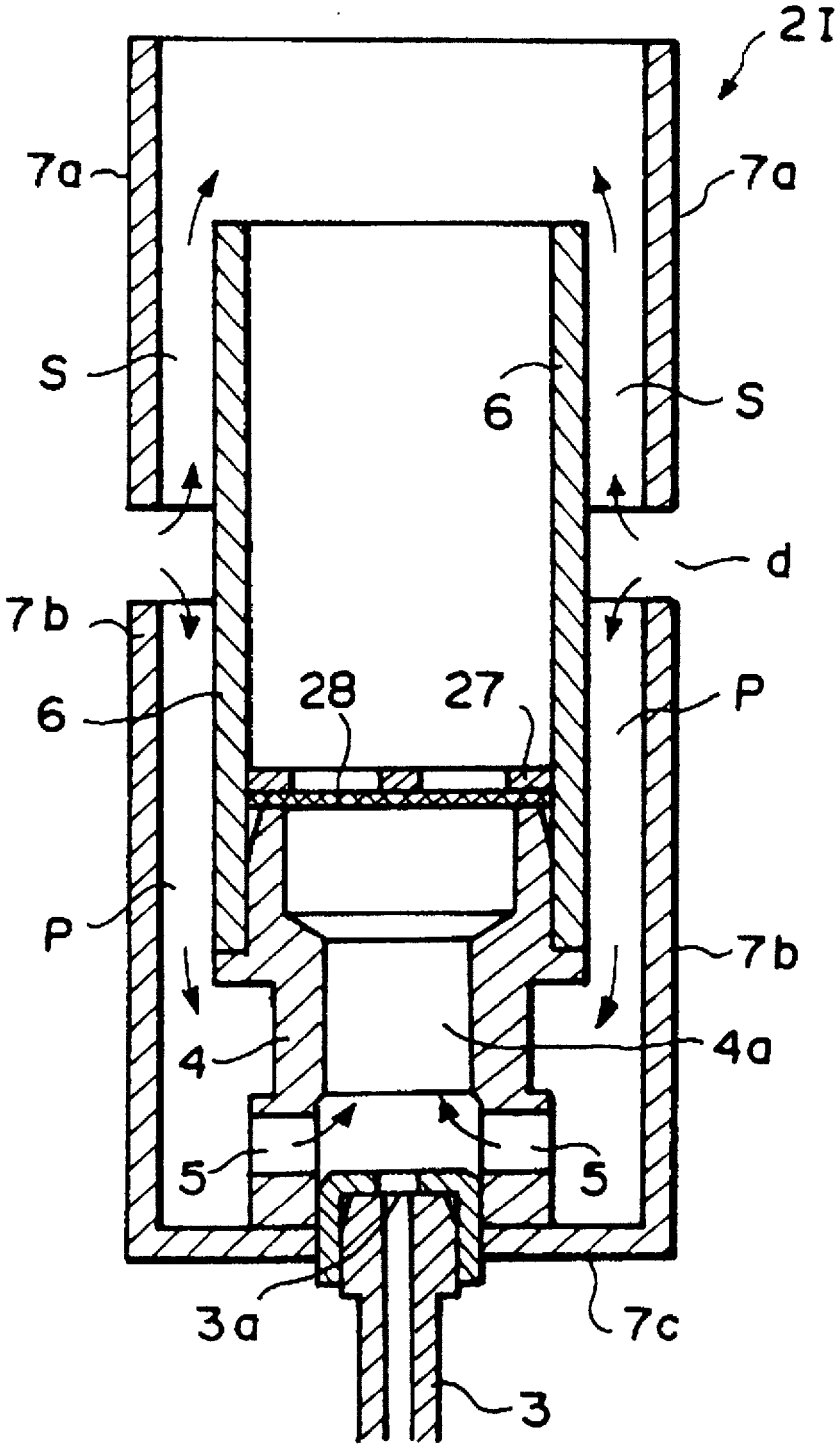
FIG. 17 is a sectional view showing a combustion cylinder in a ninth embodiment of the combustion device in accordance with the present invention.

FIG. 17 shows a combustion cylinder 2I in a ninth embodiment of the combustion device in accordance with the present invention. In the ninth embodiment, the combustion outer pipe 7 in the double-pipe structure described above is divided into upper and lower parts.

The combustion cylinder 2I comprises the base member 4, into which the top end of the nozzle 3 for jetting the fuel gas can be fitted. The primary air hole 5 opens through the side wall of the base member 4. The combustion inner pipe 6 is secured to the portion of the base member 4 above the primary air hole 5. Also, a top-portion combustion outer pipe 7*a* and a base-portion combustion outer pipe 7*b* are located around the outer periphery of the combustion inner pipe 6 and at a predetermined spacing from the combustion inner pipe 6. In this manner, a generally double-pipe structure is formed.

The combustion outer pipe is divided into the top-portion combustion outer pipe 7*a* and the base-portion combustion outer pipe 7*b* by an air introducing section d, which is annular and is located at an intermediate position of the combustion outer pipe. The top end of the top-portion combustion outer pipe 7*a* protrudes upwardly beyond the top end of the combustion inner pipe 6. The upper half of the combustion cylinder 2I is constituted in the same manner as that in the first embodiment shown in FIG. 2.

The bottom end of the base-portion combustion outer pipe 7*b* is extended downwardly, is bent inwardly at a position below the primary air hole 5 of the base member 4, and continues to a bottom wall 7*c*. The inner end of the bottom wall 7*c* is secured to the bottom of the base member 4.

In this structure, the path P, which is defined between the combustion inner pipe 6 and the base-portion combustion outer pipe 7*b*, communicates with the primary air hole 5. The primary air is introduced from the air introducing section d, which is located at the top end of the base-portion combustion outer pipe 7*b*, and through the path P. Also, the path, which is defined between the combustion inner pipe 6 and the top-portion combustion outer pipe 7*a*, serves as the secondary air flow path S. The secondary air is introduced from the air introducing section d, which is located at the bottom end of the top-portion combustion outer pipe 7*a*, and through the secondary air flow path S. The secondary air, which has thus been introduced, is supplied from the top end of the combustion inner pipe 6 to the flame.

Specifically, both the primary air and the secondary air are introduced from the air introducing section d, which is formed between the top-portion combustion outer pipe 7*a* and the base-portion combustion outer pipe 7*b*. The temperature of the top-portion combustion outer pipe 7*a* rises due to the flame produced at the upper part of the region inside of the top-portion combustion outer pipe 7*a*. However, the base-portion combustion outer pipe 7*b* is separated from the top-portion combustion outer pipe 7*a*, and therefore no heat transfers from the top-portion combustion outer pipe 7*a* to the base-portion combustion outer pipe 7*b*. Further, the rise in the temperature of the base-portion combustion outer pipe 7*b* is restricted by the flow of the primary air.

The combustion state obtained with the ninth embodiment is approximately the same as that obtained with the first embodiment described above. With the ninth embodiment, the internal combustion, in which a portion of the flame is produced on the side inward from the top end of the top-portion combustion outer pipe 7*a*, can be obtained stably over a broad range of the gas flow rate. Also, the structure can be kept simple, and the rise in the temperature of the outer side surface of the combustion cylinder 2I can be restricted. The surface temperature rise characteristics of the ninth embodiment with respect to the passage of the combustion time are approximately the same as the characteristics of the fourth embodiment, which are shown in FIG. 11.

<Tenth embodiment>

Figure 18:
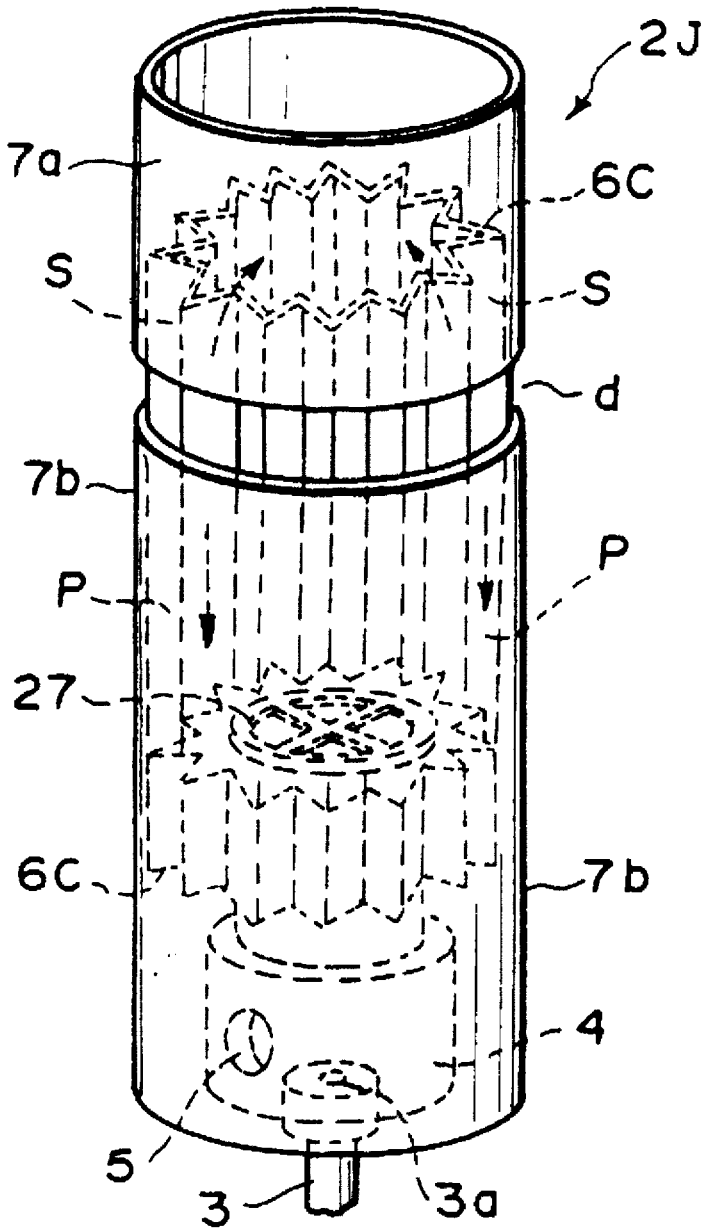
FIG. 18 is a sectional view showing a combustion cylinder in a tenth embodiment of the combustion device in accordance with the present invention.

FIG. 18 shows a combustion cylinder 2J in a tenth embodiment of the combustion device in accordance with the present invention. The structure of the combustion cylinder 2J is basically identical with the structure of the combustion cylinder 2I employed in the ninth embodiment shown in FIG. 17.

The combustion cylinder 2J employed in the tenth embodiment has the same double-pipe structure as the structure shown in FIG. 2, which is provided with the top-portion combustion outer pipe 7*a* and the base-portion combustion outer pipe 7*b*, except that the combustion inner pipe 6C, which is constituted of a pipe body formed of a corrugated sheet, is employed in lieu of the combustion inner pipe 6. Specifically, as viewed from above, the corrugated-sheet combustion inner pipe 6C is successively bent in a triangular wave-like pattern. Outer peripheral, vertically extending sides of the corrugated-sheet combustion inner pipe 6C are brought into contact with the inner surfaces of the top-portion combustion outer pipe 7*a* and the base-portion combustion outer pipe 7*b* in order to secure them. Approximately triangular prism-like spaces, which are formed between the outer surface of the corrugated-sheet combustion inner pipe 6C and the inner surface of the top-portion combustion outer pipe 7*a*, serve as the secondary air flow path S, through which the secondary air flows upwardly. The secondary air having flowed upwardly through the secondary air flow path S is supplied from the top end of the corrugated-sheet combustion inner pipe 6C to the flame. Also, approximately triangular prism-like spaces, which are formed between the outer surface of the corrugated-sheet combustion inner pipe 6C and the inner surface of the base-portion combustion outer pipe 7*b*, serve as the path P, through which the primary air flows downwardly. The primary air having flowed downwardly through the path P is introduced into the primary air hole 5.

The triangular spaces, which occur at the bottom of the inner surface of the corrugated-sheet combustion inner pipe 6C with respect to the base member 4, are closed. The other features of the structure of the combustion cylinder 2J are the same as those of the structure of the combustion cylinder 2I employed in the ninth embodiment shown in FIG. 17.

In the tenth embodiment, approximately the same combustion state as that in the ninth embodiment described above can be obtained. Also, with the tenth embodiment, the assembling and support structure of the combustion cylinder 2J can be kept simple.

<Eleventh embodiment>

Figure 19:
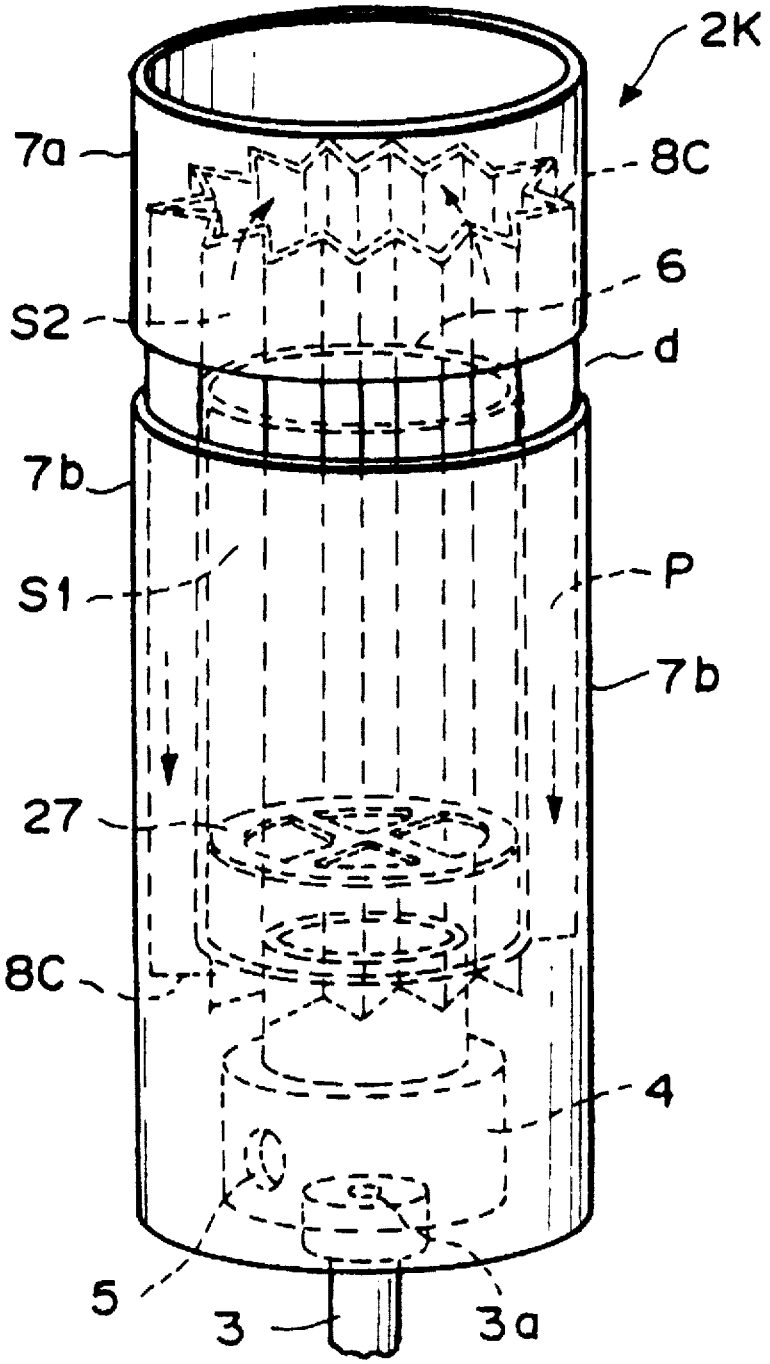
FIG. 19 is a sectional view showing a combustion cylinder in an eleventh embodiment of the combustion device in accordance with the present invention.

FIG. 19 shows a combustion cylinder 2K in an eleventh embodiment of the combustion device in accordance with the present invention. In the eleventh embodiment, an inner pipe is located at the innermost position in the combustion cylinder 2J shown in FIG. 18, and a triple-pipe structure is thereby formed. Also, the combustion outer pipe is divided into the upper and lower parts.

In the combustion cylinder 2K, the combustion inner pipe 6 is secured to the base member 4, and a corrugated-sheet combustion intermediate pipe 8C is located on the side outward from the combustion inner pipe 6. Also, the top-portion combustion outer pipe 7*a* and the base-portion combustion outer pipe 7*b* as in the tenth embodiment described above are located on the side outward from the corrugated-sheet combustion intermediate pipe 8C. The triple-pipe structure is formed in this manner.

As in the tenth embodiment described above, the air introducing section d is formed between the top-portion combustion outer pipe 7a and the base-portion combustion outer pipe 7b. The path P, which is defined between the corrugated-sheet combustion intermediate pipe 8C and the base-portion combustion outer pipe 7b, communicates with the primary air hole 5 and the secondary air flow path S1, which is defined between the combustion inner pipe 6 and the corrugated-sheet combustion intermediate pipe 8C. The primary air and the secondary air are introduced from the air introducing section d, which is located at the top end of the base-portion combustion outer pipe 7b, and through the path P. The path, which is defined between the corrugated-sheet combustion intermediate pipe 8C and the top-portion combustion outer pipe 7a, serves as the secondary air flow path S2. The secondary air, which has been introduced from the air introducing section d located at the bottom end of the top-portion combustion outer pipe 7a and through the secondary air flow path S2, is supplied from the top end of the corrugated-sheet combustion intermediate pipe 8C to the flame.

The combustion cylinder 2K can also be constituted by fitting a short, top-portion combustion outer pipe 7a to the upper part of the outer periphery of the combustion cylinder 2H employed in the eighth embodiment shown in FIG. 16.

In the ninth to eleventh embodiments described above, the top-portion combustion outer pipe 7a and the base-portion combustion outer pipe 7b are completely separated from each other by the annular air introducing section d. Alternatively, the top-portion combustion outer pipe 7a and the base-portion combustion outer pipe 7b may be partially connected with each other, and the air introducing section d may be constituted of a plurality of long slit-like openings, which are located along the circumference of the combustion outer pipe.

In the embodiments described above, the combustion cylinder extends vertically, i.e., the combustion flame is directed upwardly. The combustion device in accordance with the present invention is also applicable to lighters, such as pilot burners, which are used such that the combustion flame may be directed horizontally.

What is claimed is:

1. A gas lighter comprising:

i) a lighter body incorporating a fuel tank containing a supply of fuel gas in a lower portion of the body, a nozzle in a upper portion of the body for jetting fuel gas received from the fuel tank, a fuel conduit connecting the fuel tank with the nozzle to supply fuel gas thereto, a primary air hole in the conduit which is open to the atmosphere for introducing primary air into the fuel gas to be jetted from the nozzle, valve means for controlling the flow of fuel through the conduit to the nozzle and ii) a combustion cylinder, in which the fuel gas containing the primary air mixed in and jetted from the nozzle is burned, ignition means in the combustion cylinder for igniting the mixture of fuel gas and primary air jetted from the nozzle, and depressible actuating means for opening the valve means and actuating the ignition means, wherein the combustion cylinder has a multiple pipe multiple pipe structure comprising a combustion inner pipe surrounding the nozzle, into which the fuel gas containing the primary air mixed in flows and containing the ignition means, and a combustion outer pipe, which is located around said combustion inner pipe and at a predetermined spacing from said combustion inner pipe, and the predetermined spacing, which is defined between said combustion inner pipe and said combustion outer pipe, provides a secondary air flow through which only secondary air is supplied to a combustion flame, the primary air hole being outside the combustion outer pipe.

2. A device as defined in claim 1 wherein said multiple pipe structure comprise a combustion intermediate pipe which is in the predetermined space and defines a first space between said combustion inner pipe and said combustion intermediate pipe and a second space between said combustion intermediate pipe and said combustion outer pipe, said first and second spaces forming said secondary air flow path, through which the secondary air supplied to the combustion flame.

3. A device as define in claim 1 further comprising an auxiliary pipe which is located around the outer periphery of said combustion outer pipe and at a second predetermined spacing from said combustion outer pipe, and the combustion outer pipe has an end located farther from the nozzle than an end of the auxiliary pipe.

4. A device as defined in claim 3 wherein a third space, which is defined between said combustion outer pipe and said auxiliary pipe, and the secondary air flow path communicate with each other, and the secondary air is introduced from an open end of the third space.

5. A device as defined in claim 3 wherein a third space, which is defined between said combustion outer pipe and said auxiliary pipe and the primary air hole and the secondary air flow path communicate with each other and the primary air and the secondary air are introduced from an open end of the third space.

6. A device as defined in claim 1 wherein said combustion inner pipe is constituted of a corrugated-sheet pipe body.

7. A device as defined in claim 2 wherein said combustion intermediate pipe is constituted of a corrugated-sheet pipe body.

8. A device as defined in claim 5 wherein said combustion outer pipe is constituted of a corrugated-sheet pipe body.

9. A gas lighter according to claim 1 wherein:

an end of said combustion outer pipe remote from the nozzle is at least as far from the nozzle as an end of the combustion inner pipe which is remote from the nozzle, said combustion outer pipe has an open section to receive air which is located closer to the nozzle than the end of said combustion inner pipe which is remote from the nozzle, said combustion outer pipe being divided by said open section to receive air into a forward portion and a rearward portion, a space which is defined between said combustion inner pipe and said rearward portion of the combustion outer pipe communicates with the primary air hole, and the primary air and the secondary air are introduced through the open section in the combustion outer pipe.

10. A device as defined in claim 9 wherein said multiple pipe structure comprises a combustion intermediate pipe which is in the predetermined spacing and an end of said combustion intermediate pipe remote from the nozzle is closer to the end of said combustion outer pipe which is remote from the nozzle than said open section is, and the space which is defined between said combustion intermediate pipe and said rearward portion of the combustion outer pipe communicate with the primary air hole and with the secondary air flow path.

11. A device as defined in claim 9 wherein said combustion inner pipe is constituted of a corrugated-sheet pipe body.

12. A device as defined in claim 10 wherein said combustion intermediate pipe is constituted of a corrugated-sheet pipe body.

* * * * *

UNITED STATES PATENT AND TRADEMARK OFFICE

CERTIFICATE OF CORRECTION

PATENT NO. : 5,716,204

DATED : February 10, 1998

INVENTOR(S) : Hideo Mifune et al.

It is certified that error appears in the above-identified patent and that said Letters Patent is hereby corrected as shown below:

Column 21, line 58: "multiple pipe structure" should read --structure--.

Column 21, last line: "flow" should read --flow path--.

Column 22, line 11: "air" should read --air is--.

Column 22, line 59: "communicate" should read --communicates--.

Signed and Sealed this

First Day of December, 1998

Bruce Lehman

*Attest:*

BRUCE LEHMAN

*Attesting Officer*

*Commissioner of Patents and Trademarks*